US008829884B2

(12) United States Patent
Zhong et al.

(10) Patent No.: US 8,829,884 B2
(45) Date of Patent: Sep. 9, 2014

(54) CURRENT BALANCING CIRCUIT AND METHOD

(76) Inventors: Wenxing Zhong, Hong Kong (HK); Sinan Li, DaQing (CN); Wu Chen, Nanjing (CN); Shu Yuen Ron Hui, Shatin (HK)

( * ) Notice: Subject to any disclaimer, the term of this patent is extended or adjusted under 35 U.S.C. 154(b) by 293 days.

(21) Appl. No.: 13/512,676

(22) PCT Filed: Jan. 12, 2011

(86) PCT No.: PCT/IB2011/000033

§ 371 (c)(1),
(2), (4) Date: May 30, 2012

(87) PCT Pub. No.: WO2012/095680

PCT Pub. Date: Jul. 19, 2012

(65) Prior Publication Data

US 2012/0286753 A1 Nov. 15, 2012

(51) Int. Cl.

| | |
|---|---|
| ***G05F 3/22*** | (2006.01) |
| ***G05F 3/26*** | (2006.01) |
| ***H05B 33/08*** | (2006.01) |

(52) U.S. Cl.

CPC ..... *H05B 33/0827* (2013.01); *G05F 3/26* (2013.01)

USPC ..... 323/315; 327/108; 315/294

(58) Field of Classification Search

CPC ..... G05F 3/22; G05F 3/26

USPC ..... 323/313–317; 327/108; 315/294

See application file for complete search history.

(56) References Cited

U.S. PATENT DOCUMENTS

| | | | |
|---|---|---|---|
| 2008/0136769 | A1 | 6/2008 | Kim et al. |
| 2009/0195169 | A1 | 8/2009 | Huang et al. |
| 2010/0109537 | A1 | 5/2010 | Nishino et al. |
| 2010/0148679 | A1 | 6/2010 | Chen et al. |
| 2010/0283396 | A1 | 11/2010 | Chen et al. |

FOREIGN PATENT DOCUMENTS

| | | | |
|---|---|---|---|
| CN | 201388310 | Y | 1/2010 |

*Primary Examiner* — Harry Behm
*Assistant Examiner* — Matthew Grubb
(74) *Attorney, Agent, or Firm* — Renner Kenner Greive Bobak Taylor & Weber

(57) ABSTRACT

The present invention provides a current balancing circuit and method for balancing the respective currents in a plurality of parallel circuit branches in a target circuit. The current balancing circuit including: a plurality of balancing transistors, each having a collector, an emitter, and a base, the collector and emitter of each balancing transistor connected in series with a respective circuit branch; and a selection circuit for selectively connecting the circuit branch having the smallest current amongst the circuit branches to the bases of each balancing transistor.

32 Claims, 24 Drawing Sheets

CURRENT BALANCING CIRCUIT AND METHOD

FIELD OF THE INVENTION

The present invention relates to current balancing circuits and methods for balancing current amongst parallel branches of a target circuit.

BACKGROUND OF THE INVENTION

Current mirror techniques are known methods for creating a current source or several current sources that follow a reference current. Current sources can be, for example, light-emitting diode (LED) strings. The basic concept is illustrated in FIG. 1 based on the use of bipolar junction transistors (BJTs). Essentially, the two BJTs are assumed to be matched or identical. Usually, the current in the branch where the collector terminal and the base terminal are tied together forms the reference current. In FIG. 1, the collector current $I_{REF}$ in the BJT Q1 is used as the reference current.

The equations of this circuit are listed as follows:

$$I_{REF}=I_{C1}+2I_B \tag{1}$$

where $I_{C1}$ is the collector current of BJT Q1 and $I_B$ is the base current of both Q1 and Q2. Since $I_{C1}=\beta I_B$, equation (1) can be expressed as:

$$I_{REF}=\beta I_B+2I_B=(\beta+2)I_B \tag{2}$$

where β is the current gain of the BJT.

For BJT Q2, the collector current is:

$$I_{OUT}=\beta I_B \tag{3}$$

From (2) and (3), $$I_{OUT}=\frac{\beta}{\beta+2}I_{REF} \tag{4}$$

Since β of a BJT can be in the order of typically 40 to 250, the controlled current source $I_{OUT}$ in (4) is approximately equal to $I_{REF}$. Therefore, the controlled current source $I_{OUT}$ is said to follow the reference current source $I_{REF}$.

A current mirror circuit can also be implemented with the use of MOSFETs as shown in FIG. 2. There are other variants of current mirrors such as the Wilson current mirror shown in FIG. 3 and the improved Wilson current mirror shown in FIG. 4. In these existing methods, one branch must be fixed as the reference current source. In the traditional use of the current mirror circuit, this choice of reference current does not change.

It should be noted from existing current mirror techniques that a fixed current source is required as the reference current source. The knowledge of a known reference current source could be a major limitation in some applications such as the dynamic current balancing of LED strings.

FIG. 5 shows one example of such an application in which LED devices are arranged in three strings. Even if each LED string has the same number of series-connected LED devices, the voltage drops across the LED strings are not identical because of slight variations in characteristics of LED devices. There is even a possibility that the current imbalance may change with temperature because LED devices are sensitive to temperature.

Therefore, the imbalance of currents among LED strings is a common problem in LED applications. Such current imbalance would lead to non-uniform light generation among the LED strings. Since the lifetime of LED devices is sensitive to current, if the LED current exceeds the maximum current rating of an LED device due to current imbalance, the lifetime of the LED product would be reduced. In the article titled "Driving high-power LEDs in series-parallel arrays" by Chris Richardson in EDN Magazine, November 2008, on pages 45-49, it was pointed out that even a small voltage difference of 0.42 V between two LED strings can cause a significant current imbalance.

To cope with the current imbalance problem in parallel-connected LED strings, researchers have proposed various methods recently. In the article titled "LED Backlight Driving System for Large-Scale LCD Panels" by Huang-Jen Chiu and Shih-Jen Cheng in the IEEE Transactions on Industrial Electronics, Vol. 54, No. 5, October 2007, on pages 2751-2760, the basic current mirror technique based on an separate reference current source was proposed, as shown in FIG. 6. This approach needs a separate power supply $V_d$, a resistor $R_d$ and a BJT Qr to form the reference current source. It should be noted that this controlled reference current source is not part of the parallel LED strings, and thus, its formation involves extra costs and increased circuit complexity. This implementation also highlights the fact that existing current mirror techniques require a well-controlled current reference sources, because the current imbalance among the parallel LED strings cannot be predetermined.

Other ideas using the current mirror concept and a separate external power supply (similar to that of FIG. 6) can also be found in the following references:

(1) U.S. Pat. No. 7,605,809 to Wey et al, 20 Oct. 2009, directed to using a power supply and an extra array of comparators for current balancing in a closed-loop control manner;

(2) U.S. Pat. No. 7,642,725 to Cusinato et al, 5 Jan. 2010, directed to using a power supply and a closed-loop control circuit for balancing the LED string currents; and (3) U.S. Pat. No. 6,621,235 to Chang, 16 Sep. 2003, directed to using a power supply and a closed-loop control circuit for balancing the LED string currents.

Another previous proposal to reduce current imbalance reported in the article titled "LED Driver With Self-Adaptive Drive Voltage" by Yuequan Hu and Milan M. Jovanovic in IEEE Transactions on Power Electronics, Volume 23, Issue 6, 2008, on pages 3116-3125, uses linear current regulators which are powered by an external power supply Vcc as shown in FIG. 7*a*. The accurate circuit implementation of FIG. 7*a* is shown in FIG. 7*b*. In this approach, the current in each branch has a closed-loop control governed by a central control circuit powered by a separate power supply Vcc, as shown in FIG. 7*a*.

Ideas similar to that of FIG. 7*a* and FIG. 7*b* were also reported in (1) "A Balancing Strategy and Implementation of Current Equalizer for High Power LED Backlighting" by Chang-Hua Lin, Tsung-You Hung, Chien-Ming Wang, and Kai-Jun Pai, in International Conference on Power Electronics and Drive Systems PEDS 2007, pages 1613-1617; and (2) U.S. Pat. No. 7,675,240, 9 Mar. 2010, directed to using the same concept shown in FIG. 7*a*.

In summary, the existing current mirror concept for current balancing or sharing applications can be illustrated in FIG. 8, which highlights the requirements of: (i) an external power supply; and (ii) an associated control circuit.

It is an object of the present invention to overcome or ameliorate at least one of the disadvantages of the prior art, or to provide a useful alternative.

SUMMARY OF THE INVENTION

The present invention provides, in a first aspect, a current balancing circuit for balancing the respective currents in a plurality of parallel circuit branches in a target circuit, the current balancing circuit including: a plurality of balancing transistors, each having a collector, an emitter, and a base, the collector and emitter of each balancing transistor connected in series with a respective circuit branch; and a selection circuit for selectively connecting the circuit branch having the smallest current amongst the circuit branches to the bases of each balancing transistor.

Preferably, the current balancing circuit is passive. Also preferably, the selection circuit automatically and dynamically connects the circuit branch having the smallest current amongst the circuit branches to the bases of each balancing transistor.

Preferably, the selection circuit includes a selection switch for each circuit branch, each selection switch connected between the respective circuit branch and the base of the balancing transistor connected in the respective circuit branch, the selection circuit selectively closing one of the selection switches to selectively connect the circuit branch having the smallest current amongst the circuit branches to the bases of each balancing transistor.

Preferably, the bases of each balancing transistor are interconnected such that when the selection circuit selectively connects the circuit branch having the smallest current amongst the circuit branches to the base of one of the balancing transistors, the circuit branch having the smallest current amongst the circuit branches is also connected to the bases of the other balancing transistors.

In one embodiment, the selection circuit includes a selection diode for each circuit branch, each selection diode connected from a respective circuit branch and forwardly biased towards a first point, each selection switch connected to a second point, and the first and second points being interconnected. Preferably, the first and second points are interconnected through a limiting resistor.

Preferably, each selection switch is a switching transistor having a collector, an emitter, and a base, the collector of each switching transistor connected to the respective circuit branch, the emitter of each switching transistor connected to the base of the balancing transistor connected in the respective circuit branch, and the base of each switching transistor connected to the second point.

In another embodiment, the selection circuit includes a network of selection resistors connected between the circuit branches and the selection switches, the network of selection resistors configured to selectively close one of the selection switches to selectively connect the circuit branch having the smallest current amongst the circuit branches to the bases of each balancing transistor.

Preferably, each selection switch is a switching transistor having a collector, an emitter, and a base, the collector of each switching transistor connected to the respective circuit branch, the emitter of each switching transistor connected to the base of the balancing transistor connected in the respective circuit branch, and the base of each switching transistor connected to the network of selection resistors.

Preferably, if the current imbalance amongst the circuit branches is insufficient to drive to saturation any of the switching transistors, current from the circuit branch having the largest current amongst the circuit branches flows to each switching transistor with each switching transistor operating in a linear mode.

Preferably, the bases of each balancing transistor are interconnected, and if the current imbalance amongst the circuit branches is sufficient to drive to saturation the selection transistor connected in the circuit branch having the smallest current amongst the circuit branches, current from the circuit branch having the largest current amongst the circuit branches flows to the selection transistor connected in the circuit branch having the smallest current amongst the circuit branches, thereby connecting the circuit branch having the smallest current amongst the circuit branches to the interconnected bases of each balancing transistor.

Preferably, the current balancing circuit includes a blocking diode for each switching transistor, each blocking diode connected between the respective circuit branch and the collector of the respective switching transistor with the blocking diode being forwardly biased towards the collector of the respective switching transistor.

Preferably, the current balancing circuit includes a stability resistor for each balancing transistor, each stability resistor connected in series between the emitter of the respective balancing transistor and the respective circuit branch.

Preferably, the current balancing circuit includes a feedback assistance circuit connected to the circuit branches to further balance the current in the circuit branches. Preferably, the feedback assistance circuit includes at least one opamp connected between two of the circuit branches, the opamp having an inverting input connected to one of the two circuit branches, a non-inverting input connected to the other of the two circuit branches, and an output connected to the base of the balancing transistor connected in one of the two circuit branches. In one variation, the opamp is powered by the voltage across one of the circuit branches. In another variation, the opamp is powered by a power circuit having an RC filter.

In yet another embodiment, the selection circuit fixedly sets the current of a predetermined one of the circuit branches at a value lower than the current of the other circuit branches.

Preferably, the predetermined circuit branch includes a current sink for reducing the current in the predetermined circuit branch. The current sink is preferably a resistive component, such as a resistor.

Preferably, the selection circuit includes a connection between the predetermined circuit branch and the bases of each balancing transistor.

In a second aspect, the present invention provides a method for balancing the respective currents in a plurality of parallel circuit branches in a target circuit, the method including: providing a plurality of balancing transistors, each having a collector, an emitter, and a base, the collector and emitter of each balancing transistor connected in series with a respective circuit branch; and selectively connecting the circuit branch having the smallest current amongst the circuit branches to the bases of each balancing transistor.

Preferably, the circuit branch having the smallest current amongst the circuit branches is selectively connected to the bases of each balancing transistor using passive circuitry.

Preferably, the method includes automatically and dynamically connecting the circuit branch having the smallest current amongst the circuit branches to the bases of each balancing transistor.

Preferably, the method includes further balancing the currents in the circuit branches using feedback assistance by obtaining feedback from the circuit branches and adjusting the currents based on the feedback.

In one embodiment, the method includes fixedly setting the current of a predetermined one of the circuit branches at a value lower than the current of the other circuit branches.

Preferably, the method includes providing a current sink in the predetermined branch for reducing the current in the predetermined circuit branch.

BRIEF DESCRIPTION OF THE FIGURES

Preferred embodiments in accordance with the best mode of the present invention will now be described, by way of example only, with reference to the accompanying figures, in which.

DETAILED DESCRIPTION OF THE BEST MODE OF THE INVENTION

The present invention provides a current balancing circuit and method that overcomes or ameliorates the problems of the prior art discussed above. Another major problem of using existing current mirror circuits and methods for parallel branches in a target circuit, which is not mentioned in the literature, is that unless a separate well-controlled reference current source is used, it is not easy to select the best current source in one of the parallel branches as the reference.

Figure 5:
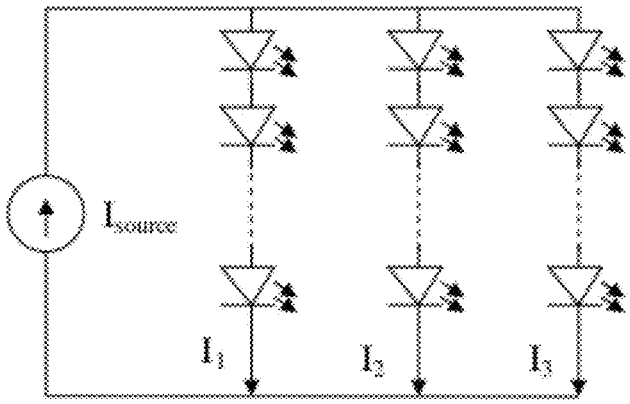
FIG. 5 Prior Art
FIG. 5 is a schematic diagram of parallel-connected LED strings with imbalanced currents.
Figure 6:
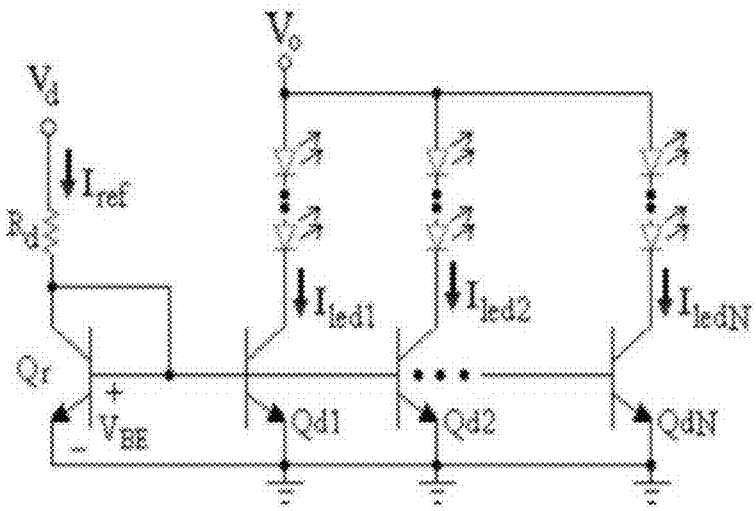
FIG. 6 Prior Art
FIG. 6 is a schematic diagram of a current mirror circuit of the prior art for balancing currents in parallel-connected LED strings, showing that an external power supply and a control circuit are required.
Figure 7A:
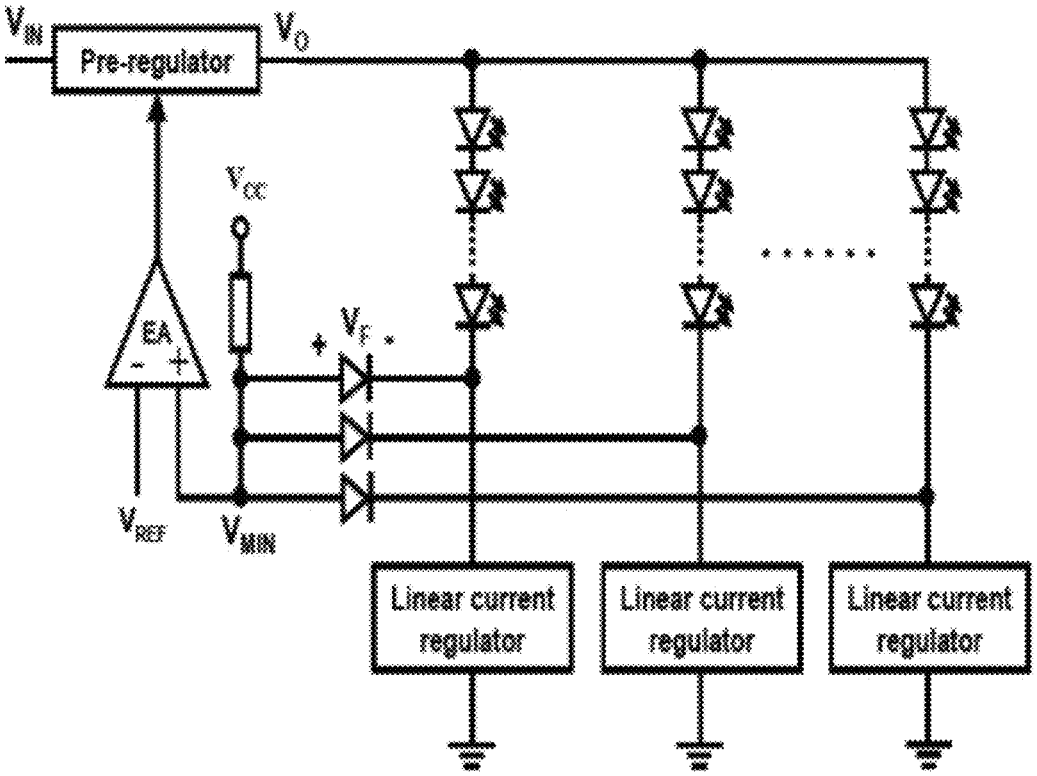
FIG. 7a Prior Art
FIG. 7*a* is a schematic diagram of a current mirror circuit of the prior art for balancing LED strings, using linear current regulators powered by a separate external power supply $V_{CC}$ and a requiring a control circuit.
Figure 7B:
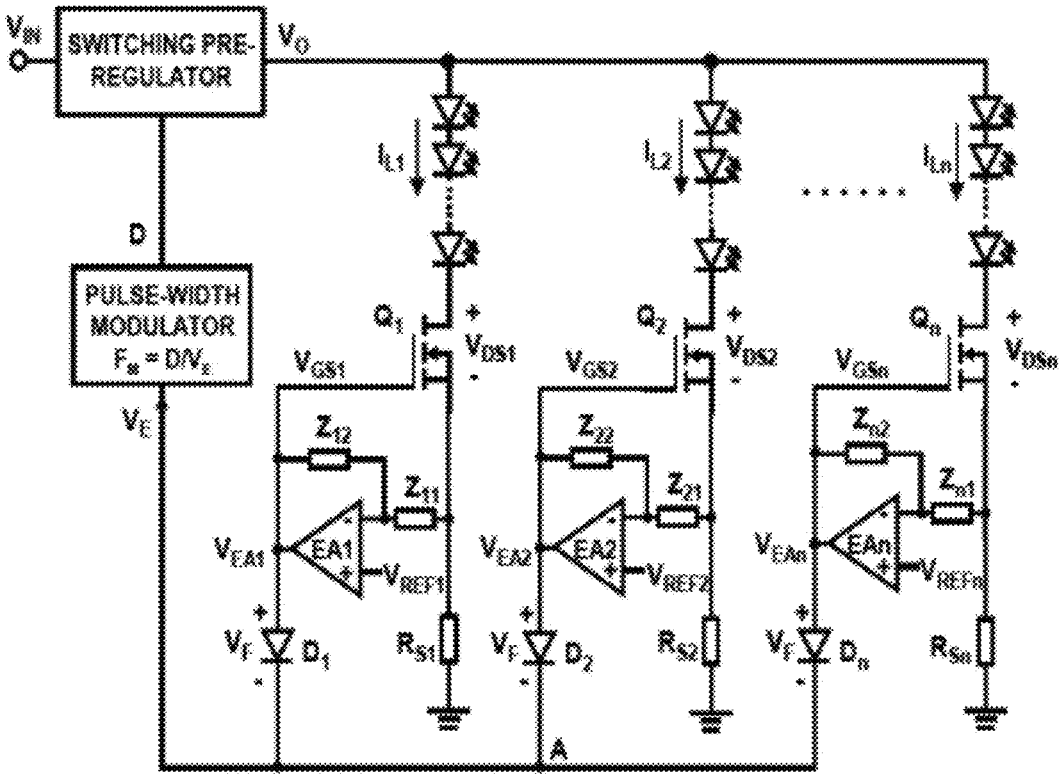
FIG. 7b Prior Art
FIG. 7*b* is a schematic diagram of an implementation of the circuit depicted in FIG. 7*a;*
Figure 8:
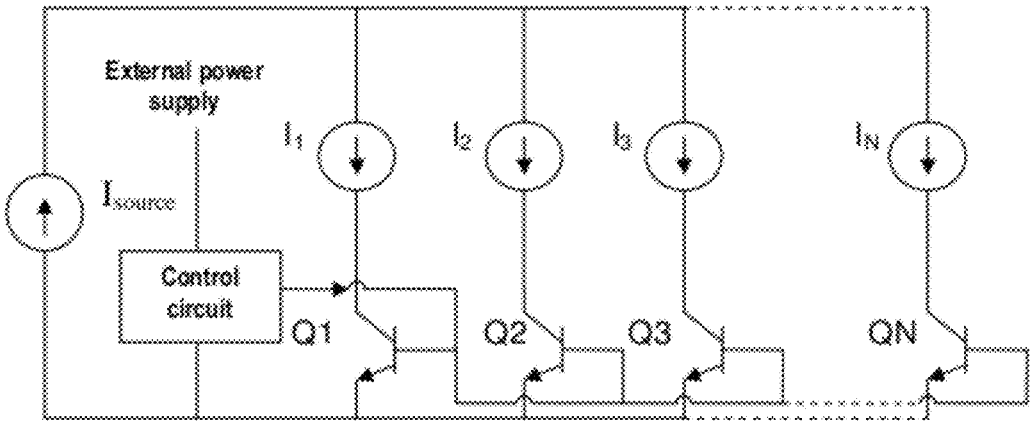
FIG. 8 Prior Art
FIG. 8 is a schematic diagram of a generalized current mirror circuit of the prior art for balancing currents in parallel circuit branches, showing that an external power supply and a control circuit are required.

In the example of FIG. 5, the amount of current imbalance between the parallel light-emitting diode (LED) strings is usually not known. Choosing the proper current reference for the current mirror circuit in this unknown situation becomes a significant practical issue. This problem can be explained with the following description.

Figure 9:
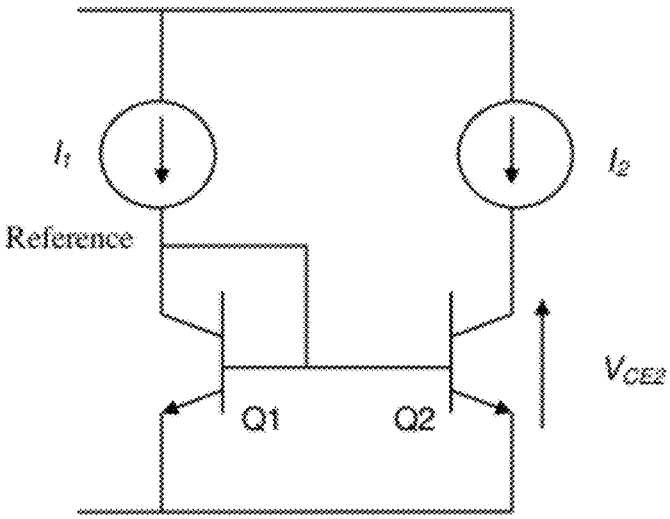
FIG. 9 Prior Art
FIG. 9 is a schematic diagram of an experimental setup of a current mirror circuit of the prior art.

Consider two parallel LED strings represented as current sources in FIG. 9. If $I_1$ is smaller than $I_2$, then $I_1$ can be used as the reference current in the basic current mirror circuit for current balancing. This is because the BJT Q2 can be operated in the "linear mode" so that the voltage across its collector and emitter terminals ($V_{CE2}$) will be controlled by the current mirror action in the LED string-2 in order to reduce the voltage imbalance among the LED strings and therefore reduce $I_2$.

However, if $I_1$ is greater than $I_2$, then even if Q2 is saturated (i.e. fully turned on in the saturation mode) with minimum $V_{CE2}$, $I_2$ may not be increased sufficiently to match $I_1$ (if $I_1$ is much larger than $I_2$. This means that for reducing the current imbalance among parallel LED strings, the best choice as the reference current source is the LED string with the lowest current.

Figure 10A:
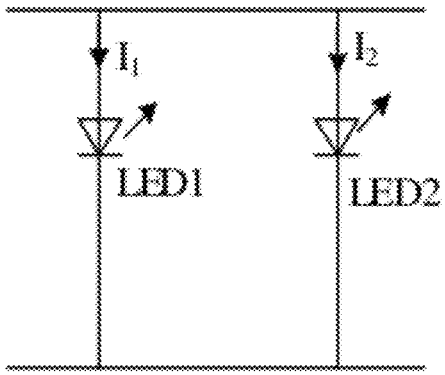
FIG. 10*a* is a schematic diagram of an experimental setup of a target circuit having two parallel LED strings in which one string (string-1) has a current $I_1$ that is smaller than the current $I_2$ in the other string (string-2) ($I_1<I_2$)

In order to confirm this important point, several sets of experiments based on the BJT current mirror circuit of FIG. 1 have been conducted, with the results tabulated in Table 1 below. FIG. 10*a* shows two LED strings with imbalanced current as tabulated in Table 1.

TABLE 1

Experimental results for current mirror circuit shown in FIGS. 10a to 10g.

Figure 10B:
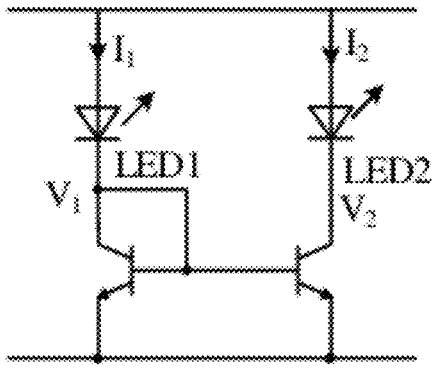
FIG. 10*b* is a schematic diagram of the experimental setup of FIG. 10*a* further including a current mirror circuit of the prior art in which the smaller current $I_1$ in string-1 is used as the reference current.
Figure 10C:
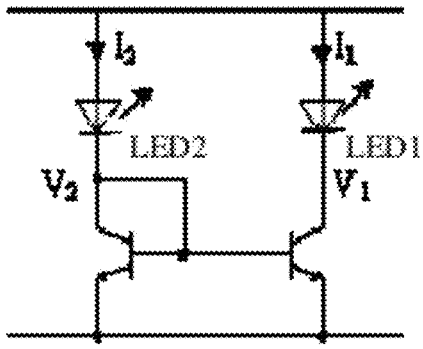
FIG. 10*c* is a schematic diagram of the experimental setup of FIG. 10*a* further including a current mirror circuit of the prior art in which the larger current $I_2$ in string-2 is used as the reference current.
Figure 10D:
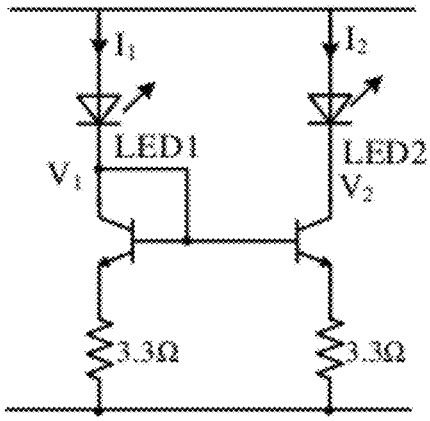
FIG. 10*d* is a schematic diagram of the experimental setup of FIG. 10*b* further including resistors to avoid transistor saturation.
Figure 10E:
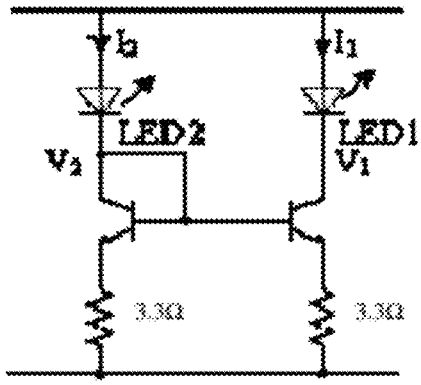
FIG. 10*e* is a schematic diagram of the experimental setup of FIG. 10*c* further including resistors to avoid transistor saturation.
Figure 10F:
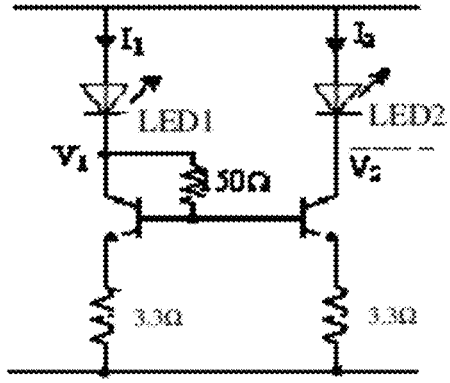
FIG. 10*f* is a schematic diagram of the experimental setup of FIG. 10*d* further including additional resistors to avoid transistor saturation.
Figure 10G:
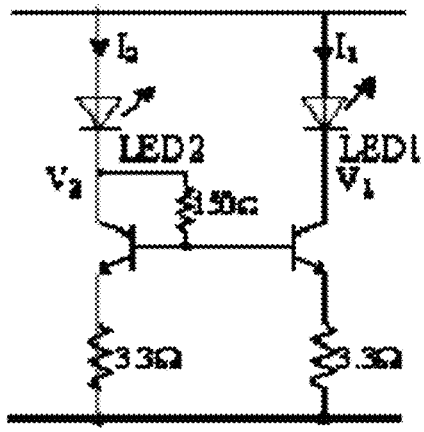
FIG. 10*g* is a schematic diagram of the experimental setup of FIG. 10*e* further including additional resistors to avoid transistor saturation.

| | Reference Current | Current (mA) | $V_{CE}$ (V) | Mirror Current | Current (mA) | $V_{CE}$ (V) | Current imbalance (mA) | Success |
|---|---|---|---|---|---|---|---|---|
| FIG. 10a | String 1 (Smaller current) | 234 | | String 2 (Larger current) | 284 | | 50 | As benchmark |
| FIG. 10b | String 1 | 237 | 0.91 Q1 linear | String 2 | 282 | 1.1 Q2 nonlinear | 45 | No Transistor Q2 Thermal runaway |
| FIG. 10c | String 2 | 286 | 0.95 Q2 Linear | String 1 | 232 | 0.5 Q1 Saturated | 54 | No Large current as $I_{ref}$ Transistor saturated |
| FIG. 10d | String 1 | 252 | 1.73 Q1 Linear | String 2 | 263 | 2.79 Q2 Linear | 11 | Yes ✓ Small current as $I_{ref}$ Transistor linear |
| FIG. 10e | String 2 | 282 | 1.8 Q2 Linear | String 1 | 236 | 1.07 Q1 Saturated | 46 | No Large current as $I_{ref}$ Transistor saturated |
| FIG. 10f | String 1 | 251 | 2.98 | String 2 | 262 | 3.67 | 11 | Yes ✓ Small current as $I_{ref}$ Transistor linear |
| FIG. 10g | String 2 | 272 | 3 | String 1 | 242 | 1.75 | 30 | No Large current as $I_{ref}$ Transistor linear |

In summary, referring to the experimental results in Table 1, the reduction of current imbalance amongst parallel LED strings can be achieved under three conditions:

(1) the smallest current source is chosen as the reference current;

(2) the transistors should be operated in the linear region (and not the saturation region); and (3) no thermal runaway of transistors should occur.

Conditions (2) and (3) can usually be met with careful circuit design. However, condition (1) is a general issue for current balancing of parallel circuit branches, such as parallel LED strings, because one never knows in mass production which LED string has the smallest current among several parallel LED strings in the product, unless every LED string is tested before production.

Referring to FIGS. 11 to 29, a preferred embodiment of the present provides a current balancing circuit for balancing the respective currents in a plurality of parallel circuit branches in a target circuit. The current balancing circuit includes a plurality of balancing transistors Q1 to QN, each having a collector, an emitter, and a base, the collector and emitter of each balancing transistor connected in series with a respective circuit branch. The current balancing circuit also includes a selection circuit for selectively connecting the circuit branch having the smallest current amongst the circuit branches to the bases of each balancing transistor. The current balancing circuit is preferably passive, only including passive circuit components, and therefore, does not require a separate or external power supply.

The selection circuit automatically and dynamically connects the circuit branch having the smallest current amongst the circuit branches to the bases of each balancing transistor.

The selection circuit includes a selection switch S1 to SN for each circuit branch, with each selection switch connected between the respective circuit branch and the base of the balancing transistor connected in the respective circuit branch. The selection circuit selectively closes one of the selection switches to selectively connect the circuit branch having the smallest current amongst the circuit branches to the bases of each balancing transistor.

In some embodiments, the bases of each balancing transistor are interconnected such that when the selection circuit selectively connects the circuit branch having the smallest current amongst the circuit branches to the base of one of the balancing transistors, the circuit branch having the smallest current amongst the circuit branches is also connected to the bases of the other balancing transistors. Preferably, the bases of each balancing transistor are simply interconnected with a wired connection.

In one embodiment, the selection circuit includes a selection diode D1 to DN for each circuit branch, each selection diode connected from a respective circuit branch and forwardly biased towards a first point, point A, each selection switch connected to a second point, point B, and the first and second points being interconnected. Points A and B are interconnected through a limiting resistor $R_B$.

Each selection switch S1 to SN is a switching transistor having a collector, an emitter, and a base, the collector of each switching transistor connected to the respective circuit branch, the emitter of each switching transistor connected to the base of the balancing transistor connected in the respective circuit branch, and the base of each switching transistor connected to the second point. It will be appreciated that each switching transistor can also be referred to as S1 to SN.

If the current imbalance amongst the circuit branches is insufficient to drive to saturation any of the switching transistors S1 to SN, current from the circuit branch having the largest current amongst the circuit branches flows to each switching transistor with each switching transistor operating in a linear mode.

If the bases of each balancing transistor Q1 to QN are interconnected (for example, to point C shown in the figures), and if the current imbalance amongst the circuit branches is sufficient to drive to saturation the selection transistor connected in the circuit branch having the smallest current amongst the circuit branches, current from the circuit branch having the largest current amongst the circuit branches flows to the selection transistor connected in the circuit branch having the smallest current amongst the circuit branches, thereby connecting the circuit branch having the smallest current amongst the circuit branches to the interconnected bases of each balancing transistor.

The current balancing circuit also includes a blocking diode $D_B$ for each switching transistor S1 to SN, each blocking diode connected between the respective circuit branch and the collector of the respective switching transistor with the blocking diode being forwardly biased towards the collector of the respective switching transistor. The blocking diodes $D_B$ block the main circulating circuit if there is an open-circuit fault in one of the circuit branches.

Figure 17:
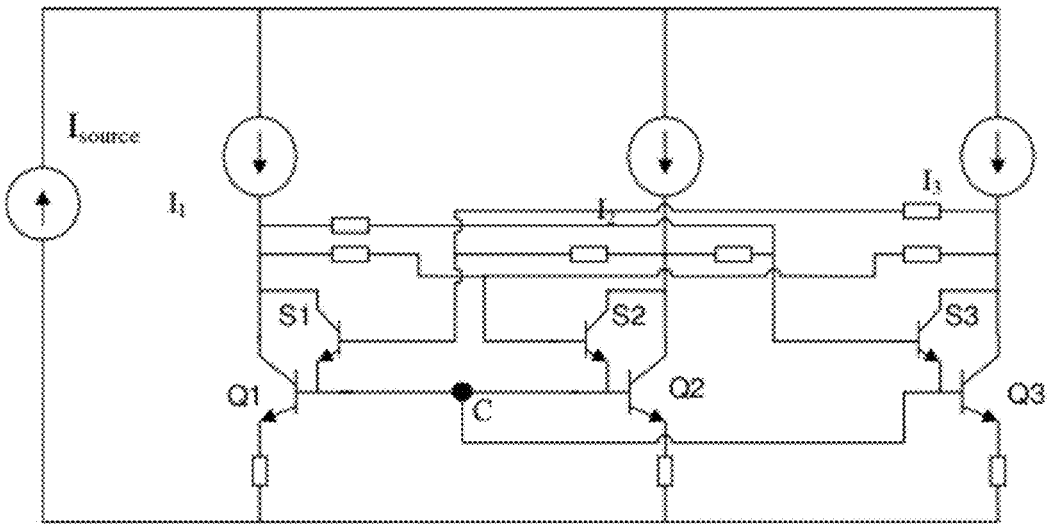
FIG. 17 is a schematic diagram of a current balancing circuit in accordance with yet another embodiment of the present invention.
Figure 18:
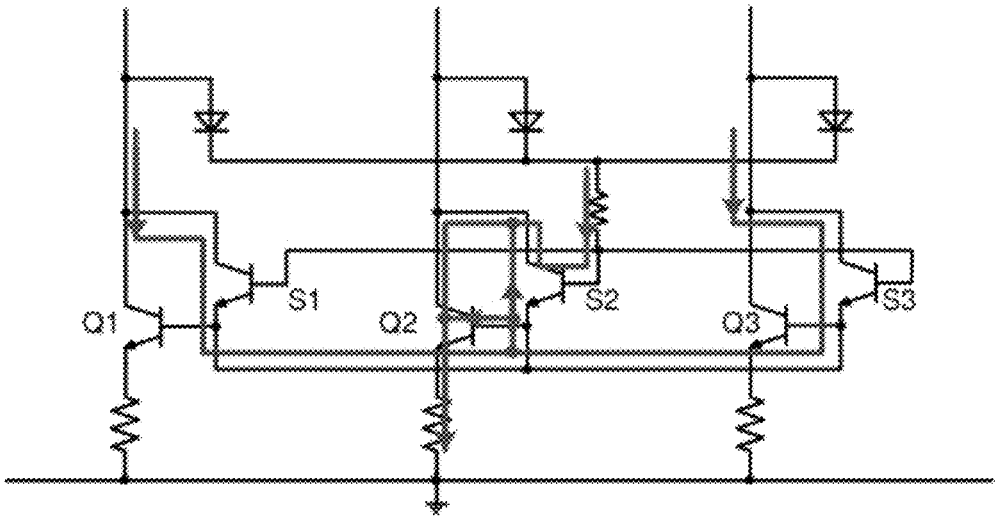
FIG. 18 is a schematic diagram of a current balancing circuit in accordance with an embodiment of the present invention in which abnormal current flow is highlighted.

In another embodiment, best shown in FIG. 17, the selection circuit includes a network of selection resistors connected between the circuit branches and the selection switches S1 to SN, the network of selection resistors configured to selectively close one of the selection switches to selectively connect the circuit branch having the smallest current amongst the circuit branches to the bases of each balancing transistor Q1 to QN.

Each selection switch is a switching transistor having a collector, an emitter, and a base, the collector of each switching transistor connected to the respective circuit branch, the emitter of each switching transistor connected to the base of the balancing transistor connected in the respective circuit branch, and the base of each switching transistor connected to the network of selection resistors.

If the current imbalance amongst the circuit branches is insufficient to drive to saturation any of the switching transistors S1 to SN, current from the circuit branch having the largest current amongst the circuit branches flows to each switching transistor with each switching transistor operating in a linear mode.

If the bases of each balancing transistor Q1 to QN are interconnected, and if the current imbalance amongst the circuit branches is sufficient to drive to saturation the selection transistor connected in the circuit branch having the smallest current amongst the circuit branches, current from the circuit branch having the largest current amongst the circuit branches flows to the selection transistor connected in the circuit branch having the smallest current amongst the circuit branches, thereby connecting the circuit branch having the smallest current amongst the circuit branches to the interconnected bases of each balancing transistor.

The current balancing circuit of this present embodiment also includes a blocking diode $D_B$ for each switching transistor S1 to SN, each blocking diode connected between the respective circuit branch and the collector of the respective switching transistor with the blocking diode being forwardly biased towards the collector of the respective switching transistor. The blocking diodes $D_B$ block the main circulating circuit if there is an open-circuit fault in one of the circuit branches.

Some embodiments also include a stability resistor $R_E$ for each balancing transistor Q1 to QN, each stability resistor connected in series between the emitter of the respective balancing transistor and the respective circuit branch.

Figure 26:
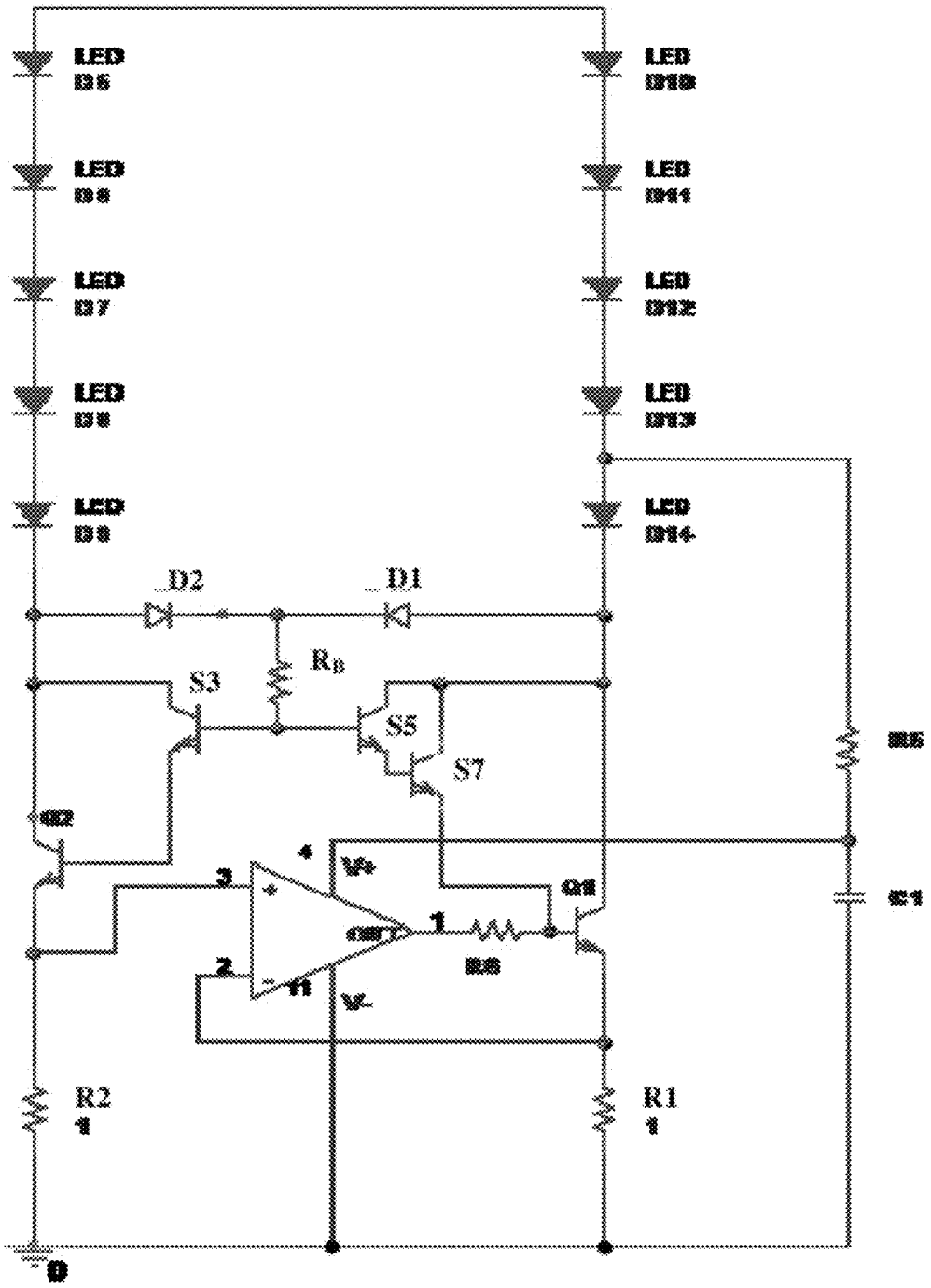
FIG. 26 is a schematic diagram of a current balancing circuit in accordance with an embodiment of the present invention which includes a feedback assistance circuit.
Figure 29:
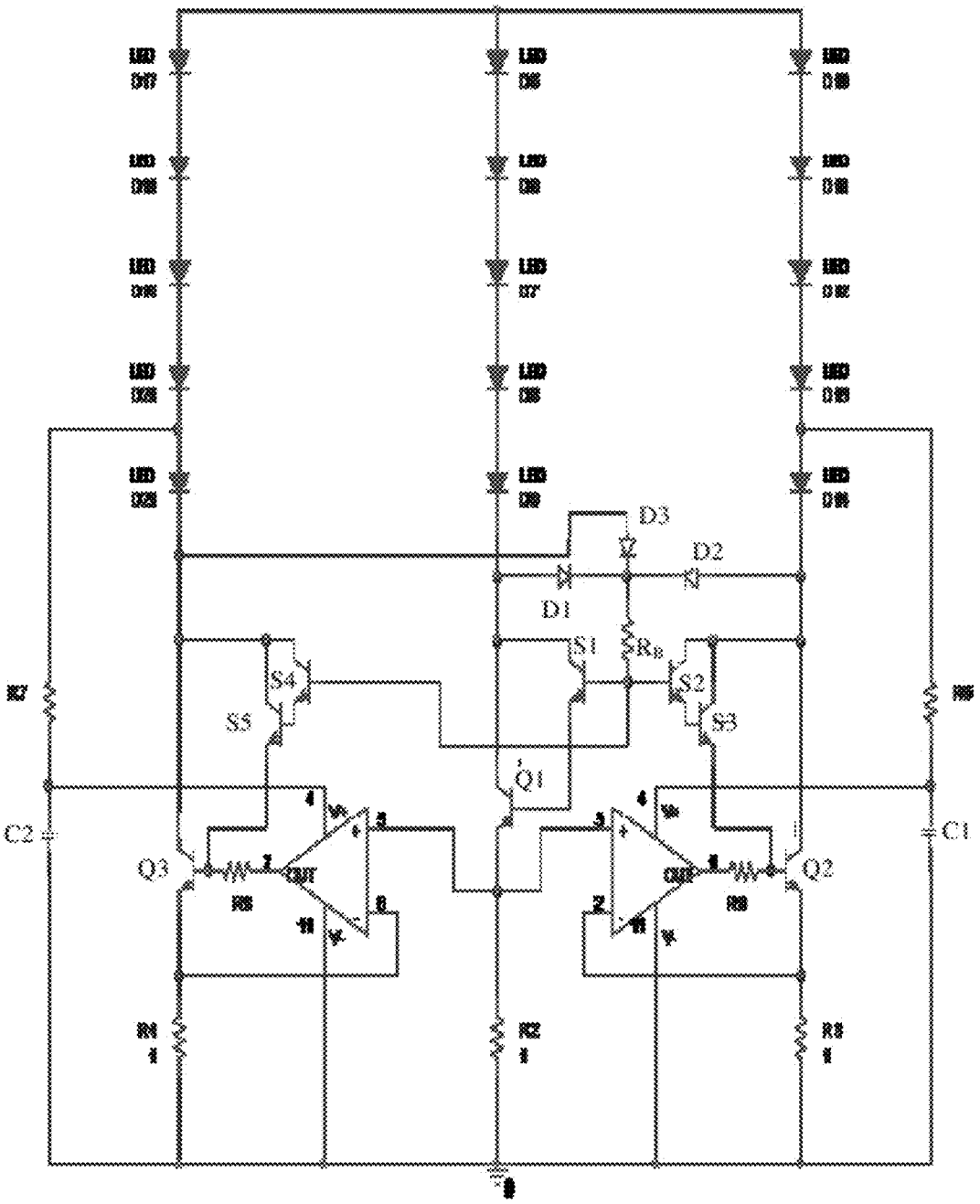
FIG. 29 is a schematic diagram of a current balancing circuit in accordance with another embodiment of the present invention which includes a feedback assistance circuit.

Certain embodiments of the current balancing circuit also include a feedback assistance circuit connected to the circuit branches to further balance the current in the circuit branches, as best shown in FIGS. 26 and 29.

The feedback assistance circuit includes at least one opamp connected between two of the circuit branches, the opamp having an inverting input (v−) connected to one of the two circuit branches, a non-inverting input (v+) connected to the other of the two circuit branches, and an output (OUT) connected to the base of the balancing transistor connected in one of the two circuit branches. In one simple embodiment, the opamp is powered by the voltage across one of the circuit branches. In particular, the opamp is powered by a power circuit having an RC filter.

Figure 24:
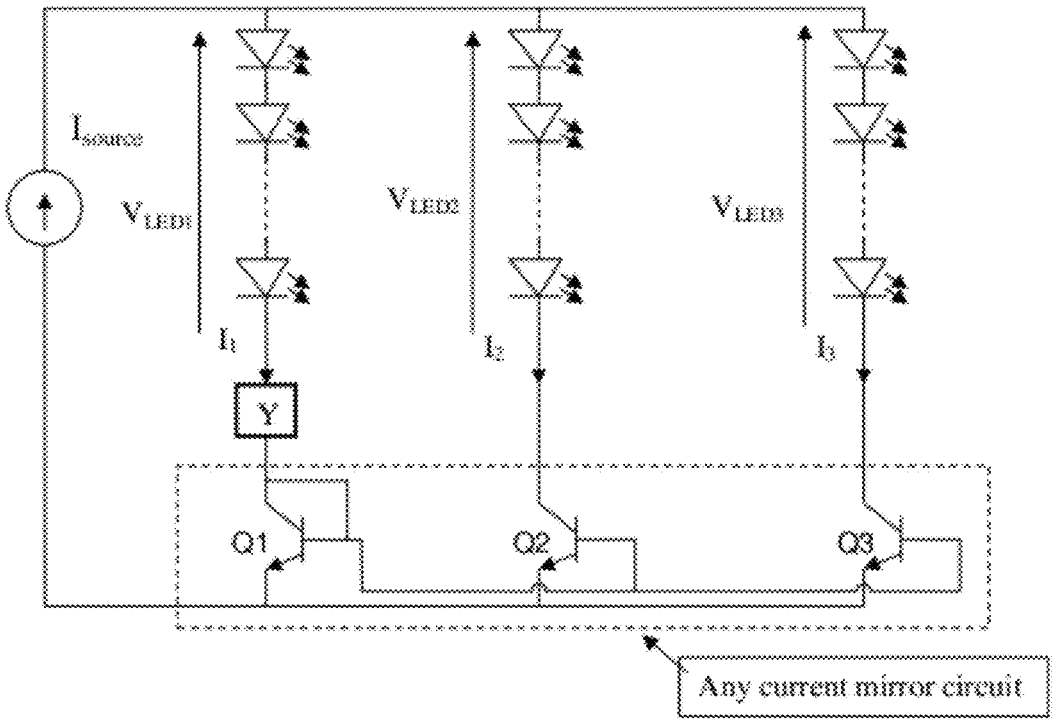
FIG. 24 is a schematic diagram of a current balancing circuit in accordance with another embodiment of the present invention.

In yet another embodiment, the current balancing circuit includes a selection circuit that fixedly sets the current of a predetermined one of the circuit branches at a value lower than the current of the other circuit branches, as best shown in FIG. 24. The selection circuit includes a connection between the predetermined circuit branch and the bases of each balancing transistor.

In some embodiments, the predetermined circuit branch includes a current sink for reducing the current in the predetermined circuit branch. Preferably, the current sink is a resistive component, such as a resistor.

Referring to the foregoing, the present invention is directed to a novel self-configurable circuit mirror principle that can automatically and dynamically detect and select the best current source among a plurality of parallel-connected current sources (such as LED strings) as the reference current source. The proposed principle has a dynamic and self-configurable current balancing circuit structure that allows the best current source (i.e. the smallest current source in the case of current balancing of parallel LED strings) to be selected. In accordance with embodiments of the present invention, the current balancing circuits provided do not require: (i) an external power supply; and (ii) an associated control circuit.

Figure 11:
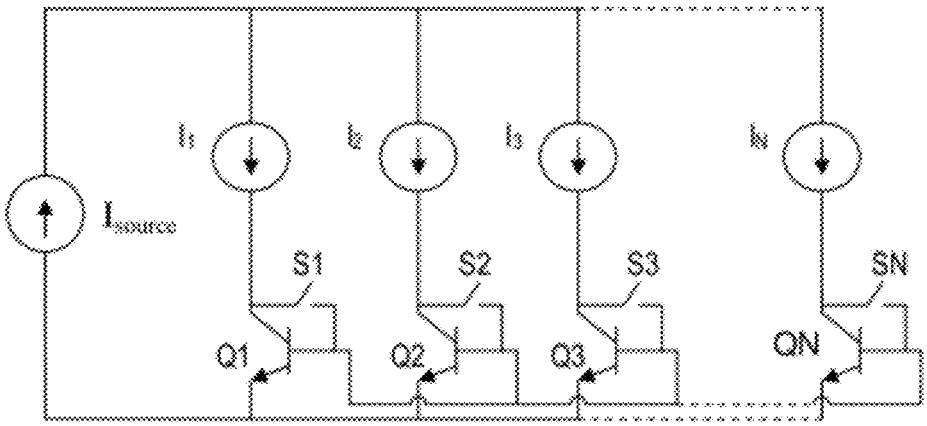
FIG. 11 is a schematic diagram of a current balancing circuit in accordance with an embodiment of the present invention.

Turning now to the figures in more detail, FIG. 11 shows a schematic of a current balancing circuit, which can also function as a current mirror circuit, according to an embodiment of the invention. Several parallel current sources (such as LED strings) are connected to the current balancing circuit, which is self-configurable. In this description, bipolar junction transistors (BJTs) are used in the self-configurable current balancing circuit. However, it should be stressed that MOSFETs can in principle be used for the same applications.

The transistors Q1 to QN (also called Q-transistors in this specification) represent the balancing transistors. Extra resistors that may be required to avoid thermal runaway in these Q-transistors are not shown in FIG. 11 for the sake of simplicity, but they may be needed in practice as later shown in the embodiment depicted in FIG. 16. Switching transistors in the form of extra transistors S1 to SN (also called S-transistors in this specification) are introduced in accordance with an embodiment of the present invention to make the current balancing circuit self-configurable, i.e. the choice of the reference current source can be changed or re-configured.

The switching transistor S1 to SN (bipolar junction transistor or MOSFET) used for selecting the best reference current source can operate either in the saturation mode or in the linear mode. When used in the saturation mode, this transistor is fully turned on as a switch to re-configure the overall circuit to select the best current source as the reference current for the current mirror or current balancing circuit. When used in the linear mode, this transistor forms part of a cascaded transistor (sometimes called Darlington transistor if BJTs are used) and the overall circuit still provides current balancing function.

The dual functionality of S1 to SN is a unique feature of the present invention as demonstrated by the present embodiment. Therefore, this invention can achieve current balancing for all of the parallel current sources regardless of whether the switching transistors S1 to SN are in the saturation mode or linear mode. This point will be illustrated by the following circuits.

In a practical situation such as having several LED strings connected in parallel, the current imbalance of the LED strings cannot be known without measurements. In this present embodiment of the invention, switching transistors S1 to SN are employed to allow the most appropriate current source to be chosen as the "reference current source". In the case of current balancing of parallel LED strings, the LED string with the smallest current should be selected. A selection circuit or detection circuit is therefore necessary to detect the best current source so that the corresponding switch can be activated and therefore selectively connect the LED string with the smallest current.

Figure 12:
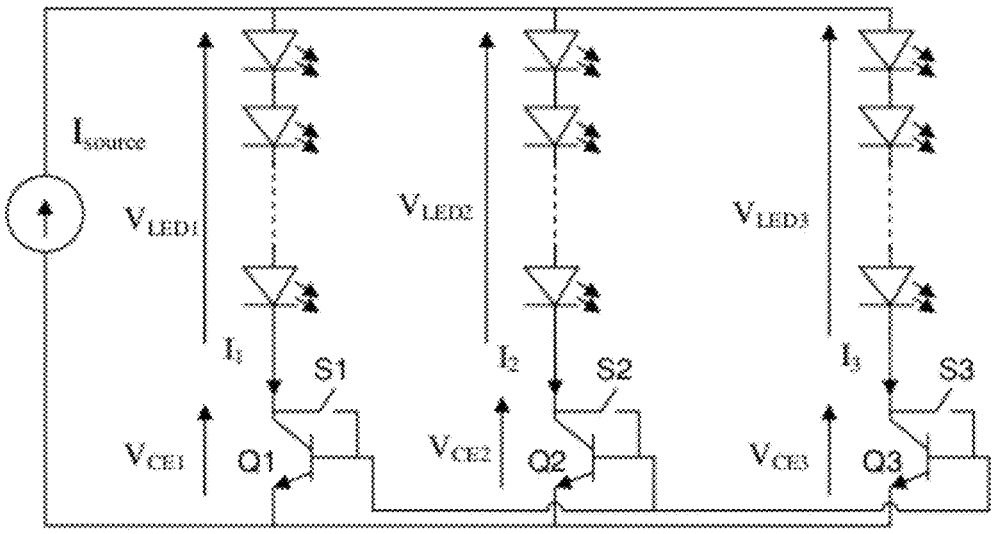
FIG. 12 is a schematic diagram of a current balancing circuit in accordance with another embodiment of the present invention in which the target circuit has parallel LED strings, with $I_1>I_2>I_3$ and $V_{CE1}>V_{CE2}>V_{CE3}$.

Referring to FIG. 12, an embodiment of the present invention applied to a target circuit with three LED strings will now be described. Although three LED strings are involved in this example, it should be noted that the invention can in principle be applied to any number of parallel current sources.

Figure 13:
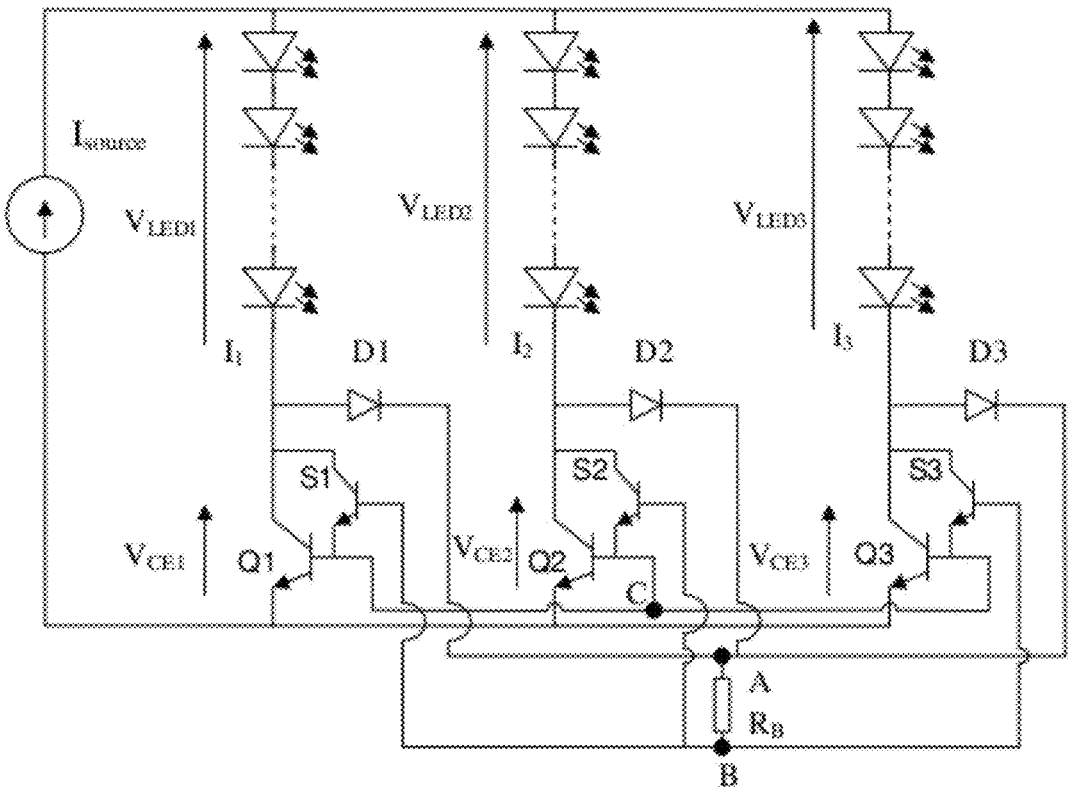
FIG. 13 is a schematic diagram of a current balancing circuit in accordance with yet another embodiment of the present invention in which the target circuit has parallel LED strings.

Now, consider the introduction of a transistor based current balancing circuit into the current-imbalanced LED system shown in FIG. 12. For the LED strings, the strings with larger currents tend to have a lower voltage drop across the LED string. Therefore, if the total LED string voltages are assumed to be $V_{LED1}<V_{LED2}<V_{LED3}$, then $I_1>I_2>I_3$, and $V_{CE1}>V_{CE2}>V_{CE3}$. Referring to FIG. 13, the self-configurable current balancing circuit includes three switches S1, S2 and S3 in the form of transistors, which will be referred to as switching transistors. These switching transistors can be used: (i) as switches in saturation mode for selecting the appropriate current source as the reference current source for the current mirror or balancing action; or (ii) as transistors in linear mode.

When used in linear mode, each transistor pair, S1-Q1, S2-Q2 and S3-Q3, also forms a Darlington transistor. For each parallel branch, a diode D1 to D3 is connected to a first point, point A, and the bases of all S-transistors S1-S3 are connected to a second point, point B. Further, the bases of all Q-transistors Q1-Q3 are connected to a third point, point C, thereby being interconnected.

The self-configurable current balancing circuit operates in two modes:

- Mode 1, in which one of the switching transistors S1 to SN is driven fully into the saturation region, and the current balancing circuit operates as a self-configurable current mirror circuit; and
- Mode 2, in which the switching transistors S1 to SN are in the linear region, and the current balancing circuit operates as a self-configurable current balancing circuit.

Mode 1 will now be described.

Figure 14A:
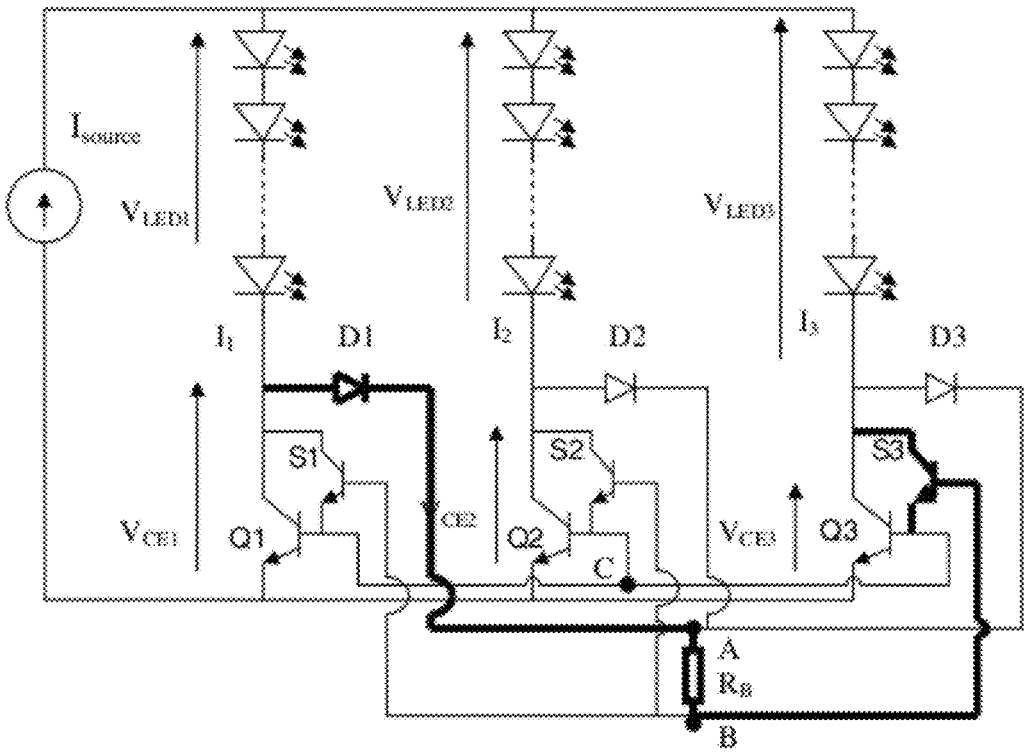
FIG. 14*a* is a schematic diagram of a current balancing circuit in accordance with a further embodiment of the present invention in which the target circuit has parallel LED strings, with $I_1>I_2>I_3$ and $V_{CE1}>V_{CE2}>V_{CE3}$, and showing the circuit branch having $I_1$ being connected to the switch $S_3$ via a conduction path shown in bold.

Using the assumption that $I_1>I_2>I_3$, and $V_{CE1}>V_{CE2}>V_{CE3}$, the self-configurable principle can be illustrated with particular reference to FIG. 14*a*. With $V_{CE1}$ being highest, the critical conducting path is highlighted with bolded line in FIG. 14*a*. Selection diode D1 is turned on and the current will flow through a current limiting resistor $R_B$ to drive the base of the switching transistor with the smallest current and $V_{CE}$ (i.e. S3 in this case). If the current imbalance is significant enough so that the current caused by $V_{CE1}$ is large enough to drive S3 into saturation (i.e. S3 is fully turned on as a closed switch), the equivalent circuit can be re-drawn as shown in FIG. 14*b*.

Figure 1:
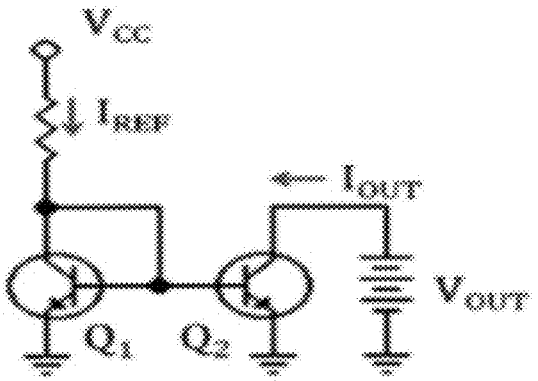
FIG. 1 Prior Art
FIG. 1 is a schematic diagram of a basic current mirror circuit of the prior art, showing that a predetermined reference current source powered by a separate power supply $V_{CC}$ is required.
Figure 2:
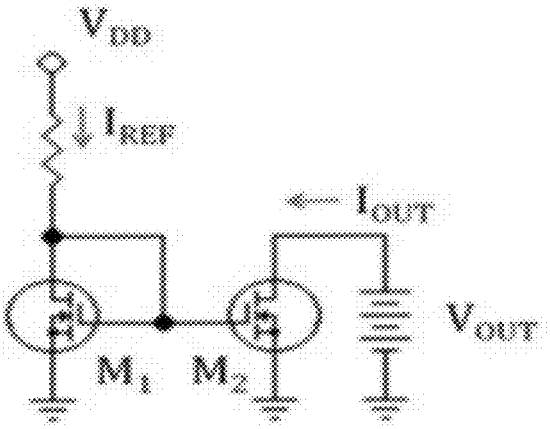
FIG. 2 Prior Art
FIG. 2 is a schematic diagram of a basic current mirror circuit of the prior art based on MOSFETs, showing that a predetermined reference current source powered by a separate power supply $V_{DD}$ is required.
Figure 3:
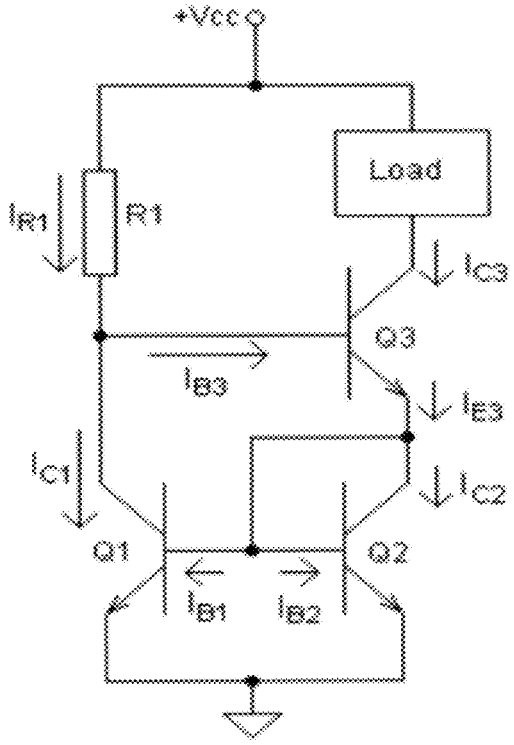
FIG. 3 Prior Art
FIG. 3 is a schematic diagram of a Wilson current mirror circuit of the prior art with a predetermined reference current source.
Figure 4:
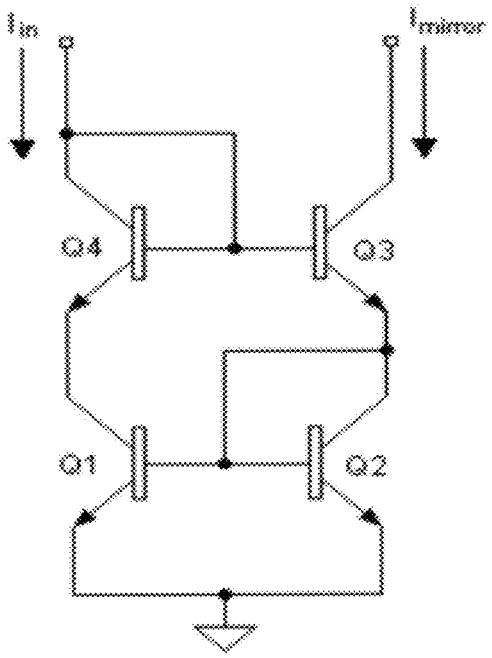
FIG. 4 Prior Art
FIG. 4 is a schematic diagram of an improved Wilson current mirror circuit of the prior art with a predetermined reference current source.
Figure 14B:
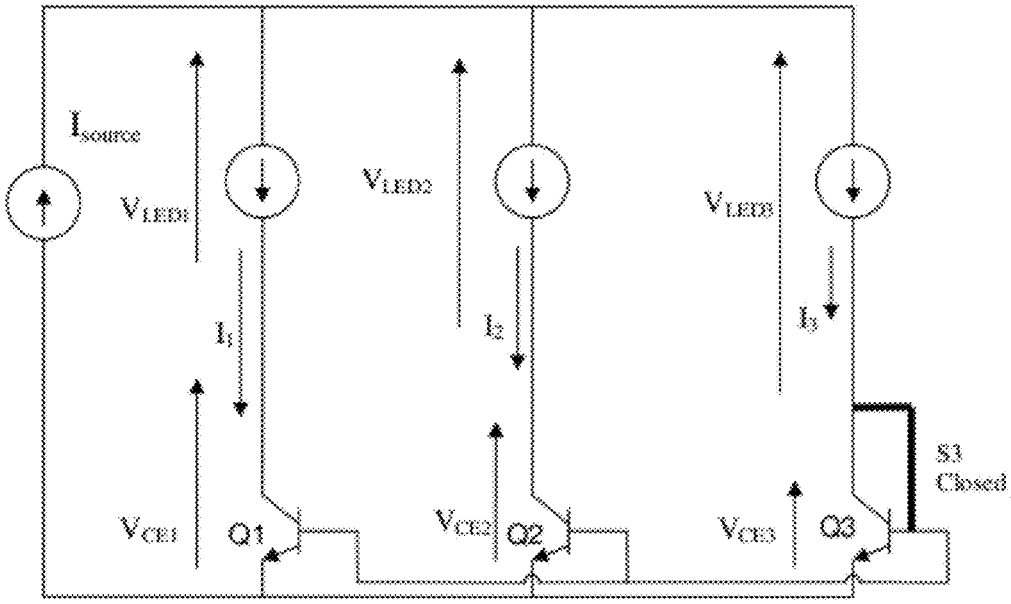
FIG. 14*b* is a schematic diagram of an effective circuit corresponding to the current balancing circuit depicted in FIG. 14*a;*

It can be seen from FIG. 14*b* that the equivalent circuit depicted is like a current mirror circuit with the smallest current source chosen as the reference current (compare with FIG. 1 and FIG. 9). Therefore, it can be seen that the proposed circuit, as depicted in FIG. 14, can automatically choose the smallest current source as the reference current. The current mirror action of this circuit will cause $V_{CE1}$ and $V_{CE2}$ to change in order reduce $I_1$ and $I_2$ to follow the reference current $I_3$. The proposed circuit allows a dynamic changing of reference current according to whichever is the smallest current source.

Thus, this operating mode is still based on the current mirror concept, except that there is a novel self-configurable feature that allows the best current source to be dynamically chosen as the reference current source for the current mirror action.

Mode 2 will now be described.

Figure 15:
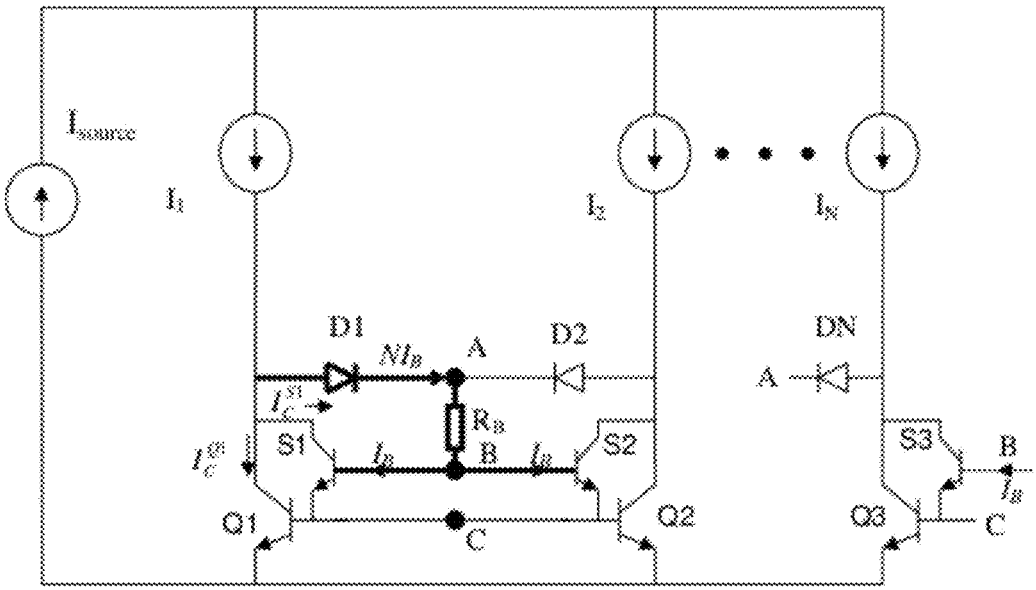
FIG. 15 is a schematic diagram of a generalized current balancing circuit in accordance with an embodiment of the present invention.

If the current imbalance among the parallel current sources is not too significant (i.e. current imbalance has been reduced), the $V_{CE}$ of the largest current source will still cause the corresponding selection diode to conduct. However, the current caused by the largest $V_{CE}$ in the largest current source may not be large enough to drive the base of the S-transistor (switching transistor) in the smallest current source into the saturation region. This means that this diode current will flow into the bases of all the S-transistors which now work in the linear region. The equivalent circuit for a system with N parallel current sources can be depicted as shown in FIG. 15.

The following assumptions are made in the analysis:

(1) the current imbalance among current sources is not large enough that none of the S-transistor is fully driven into saturation, implying the all S-transistors are operated in the linear range;

(2) all transistors are matched with the same current gain β; and (3) the current source with $I_1$ (current source-1) is largest so that its corresponding highest $V_{CE}$ will cause the diode D1 to turn on.

$$I_1=I_C^{S1}+I_C^{Q1}+NI_B \tag{5}$$

where $I_C^{S1}$=collector current of S1

$I_C^{Q1}$=collector current of Q1

N=number of current sources $I_B$=base current of S1, S2, . . . SN.

$$I_C^{S1}=\beta I_B \tag{6}$$

$$I_C^{Q1}=\beta(I_B^{Q1})=\beta(I_E^{S1}) \text{ and } I_E^{S1}=I_C^{S1}+I_B=(\beta+1)I_B$$

Hence, $$I_C^{Q1}=\beta(\beta+1)I_B \tag{7}$$

From (5), (6) and (7), $$I_1=(\beta^2+2\beta+N)I_B \tag{8}$$

Now, we can determine the current in the other branches which have currents that are less than $I_1$. For branch N, because the diode DN is not turned on, $$I_N=I_C^{SN}+I_C^{QN} \tag{9}$$

$$I_C^{SN}=\beta I_B \tag{10}$$

$$I_C^{QN}=\beta(\beta+1)I_B \tag{11}$$

From (9), (10) and (11), $$I_N=(\beta^2+2\beta)I_B \tag{12}$$

Using (8) and (12), the current $I_N$ can be expressed as:

$$I_N=\left(\frac{\beta^2+2\beta}{\beta^2+2\beta+N}\right)I_1 \tag{13}$$

For a typical current gain β of 40, $$\left(\frac{\beta^2+2\beta}{\beta^2+2\beta+N}\right)=\frac{1680}{1680+N}\approx 1 \text{ for } N<10$$

Therefore, equation (13) confirms that good current balance can be achieved theoretically even when all the S-transistors (switching transistors) are operated in the linear mode.

In summary, the proposed circuit in the presently described embodiment of the invention enables the parallel current sources to reduce the current imbalance in both Modes 1 and 2.

Figure 16:
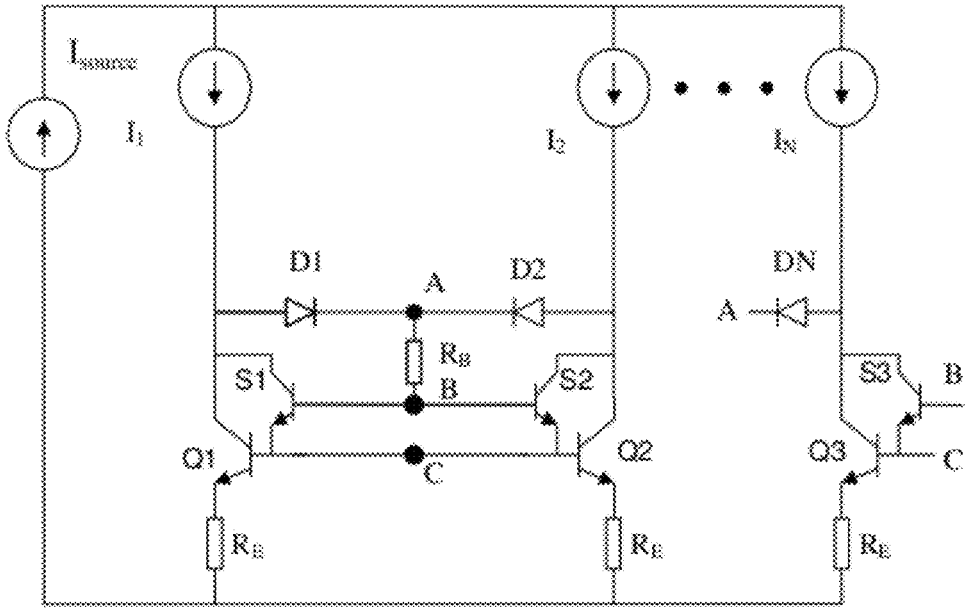
FIG. 16 is a schematic diagram of a generalized current balancing circuit in accordance with another embodiment of the present invention which includes stability resistors $R_E$.

A typical practical implementation of this approach including the stability improvement and avoidance of saturation of the Q-transistors (balancing transistors) is shown in FIG. 16, where resistors $R_B$ are resistors of small values (of typically less than a few Ohms in order to reduce conduction loss) and are used to avoid thermal runaway of the transistors. If the Q-transistor current through the collector and the emitter increases dramatically (due to thermal runaway), the increase in voltage across the emitter resistor $R_E$ will act in opposition to the base bias and thus reduce the transistor current. Therefore, the use of $R_E$ resistors with the Q-transistors can reduce the chance of thermal runaway.

For a system with three parallel current sources, an alternative implementation is shown in the embodiment depicted in FIG. 17.

In general, most LED device faults will end up as a short-circuit situation. This means that if one of the LED devices in a string fails, it behaves like a short circuit and the rest of the LED devices in the same string still work. This short-circuit fault will only reduce the overall voltage across that particular LED string and the novel self-configurable current balancing or current mirror circuit according to embodiments of the present invention will still function properly.

However, consideration has also been given to the situation in which one of the LED strings is cut off (e.g. due to a poor quality cable connection or an unusual open-circuit fault in one or more of the LED devices). In such a situation, our experimental observation shows that some currents from the normal branches will flow into the transistors of the faulty branch in the paths as highlighted in FIG. 18, resulting in abnormal currents and huge power losses in the transistors of the faulty current branch.

Figure 19A:
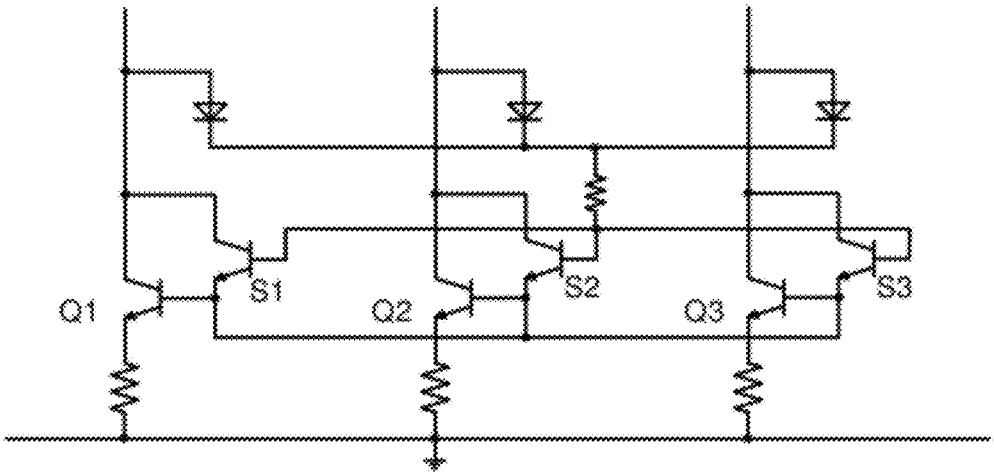
FIG. 19*a* is a schematic diagram of a current balancing circuit in accordance with an embodiment of the present invention.
Figure 19B:
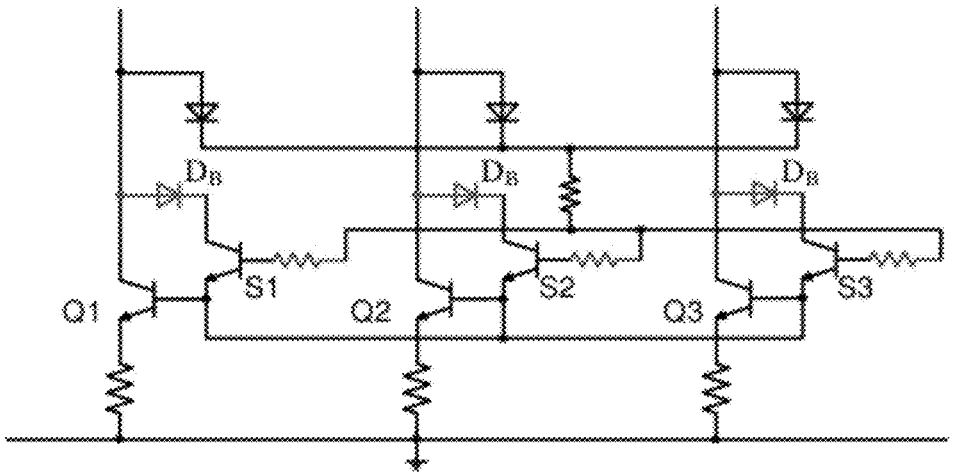
FIG. 19*b* is a schematic diagram of the current balancing circuit depicted in FIG. 19*a* further including blocking diodes to block abnormal current flow.
Figure 19C:
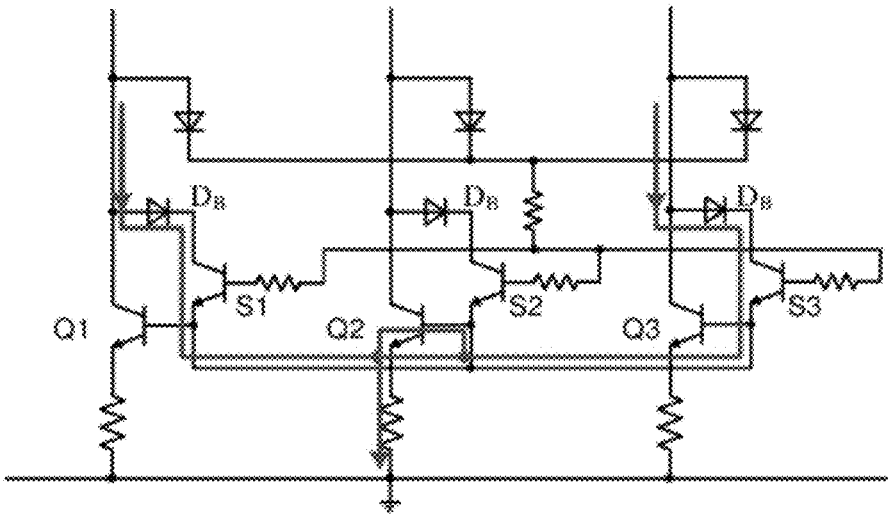
FIG. 19*c* is a schematic diagram of the current balancing circuit depicted in FIG. 19*b* in which abnormal current flow is highlighted.

In order to avoid these abnormal currents, the basic circuit proposed in embodiments of this invention can be modified from that in depicted FIG. 19*a* to a circuit, such as that depicted in FIG. 19*b*, that uses extra blocking diodes $D_B$ to block the main circulating circuit if there is an open-circuit fault in the LED string. Consequently, the new current path in the fault branch is illustrated in FIG. 19*c*, from which it can be seen that the power loss can be greatly reduced because of the low voltage drop of the base-emitter junction of the Q-transistor.

Figure 20:
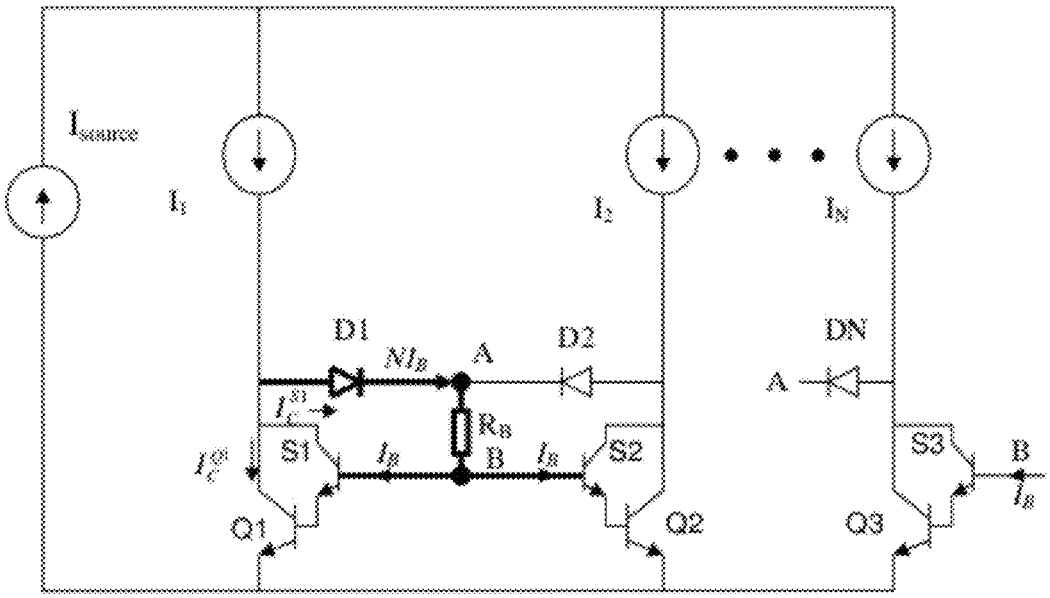
FIG. 20 is a schematic diagram of a current balancing circuit in accordance with another embodiment of the present invention.

In another alternative circuit to avoid over-heating of transistors in the case of an open-circuit fault in one of the LED strings, the basic circuit of FIG. 16 can be modified by removing the base connections of all the Q-transistors (balancing transistors) at point C as shown in FIG. 20, so that the Q-transistors are no longer interconnected. The same argument applies to the alternative circuit in FIG. 17.

Figure 21:
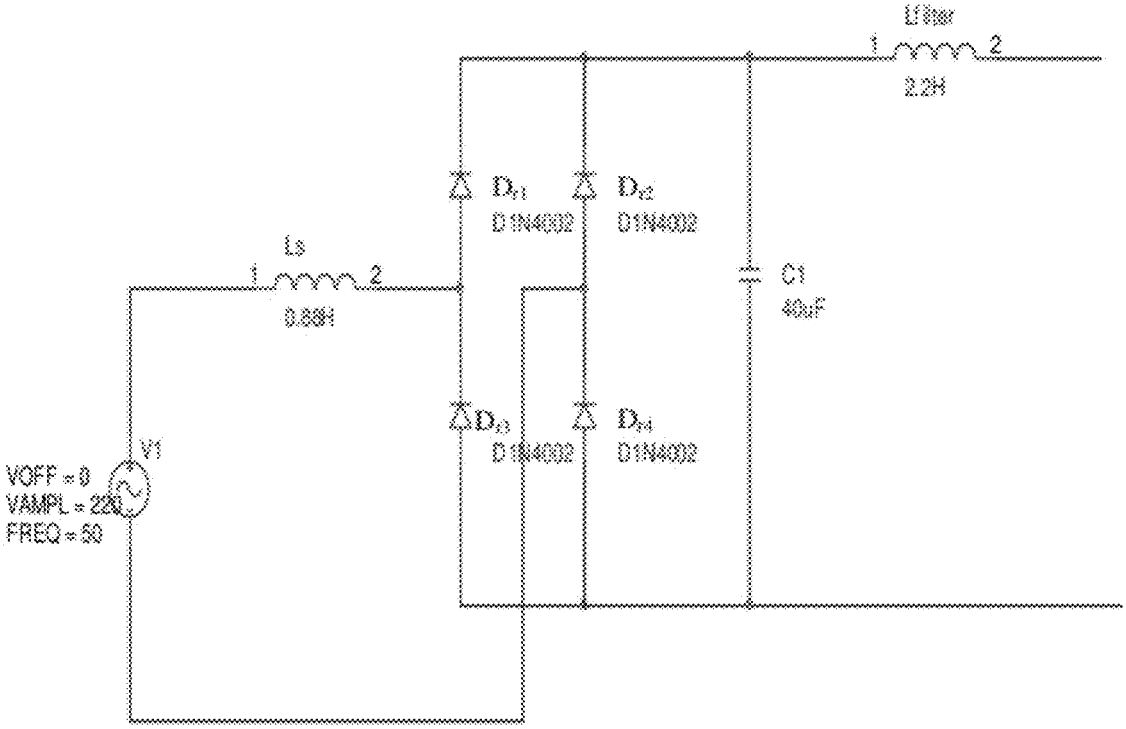
FIG. 21 is a schematic diagram of a passive LED driver that generates current source for three parallel LED strings.

In order to confirm the feasibility of embodiments of the present invention, an experimental LED system with three parallel strings was set up. The current source is provided by a simple AC-DC power circuit as shown in FIG. 21. The diode rectifier turns the AC voltage into a DC voltage with the assistance of an output capacitor. The inductor turns the voltage source into a current source.

Figure 22:
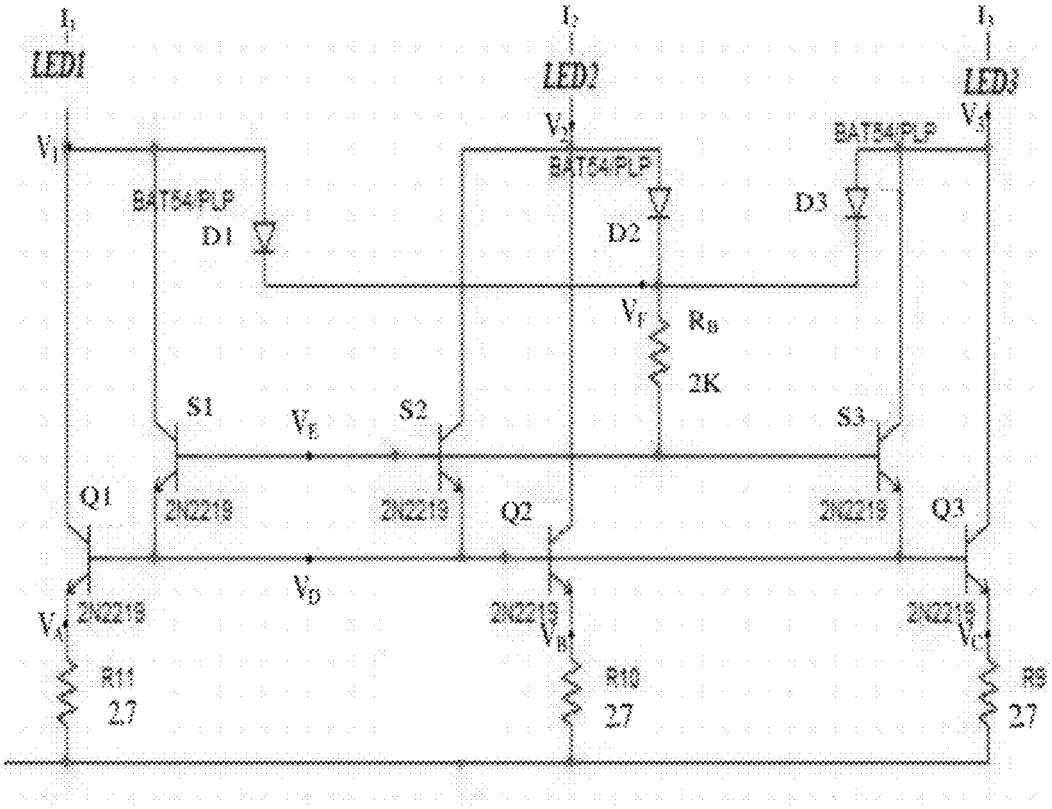
FIG. 22 is a schematic diagram of a current balancing circuit in accordance with yet another embodiment of the present invention.

Before the proposed current balancing circuit shown in FIG. 22 (based on FIG. 16) is used, the three LED string currents are:

| | | | |
|---|---|---|---|
| $I_1$ = 252 mA | $I_2$ = 231 mA | $I_3$ = 298 mA | Maximum ΔI = 67 mA |

After the circuit in FIG. 22 is used, the LED string currents become:

| | | | |
|---|---|---|---|
| $I_1$ = 250 mA | $I_2$ = 251 mA | $I_3$ = 277 mA | Maximum ΔI = 27 mA (60% imbalance reduced) |

Figure 23:
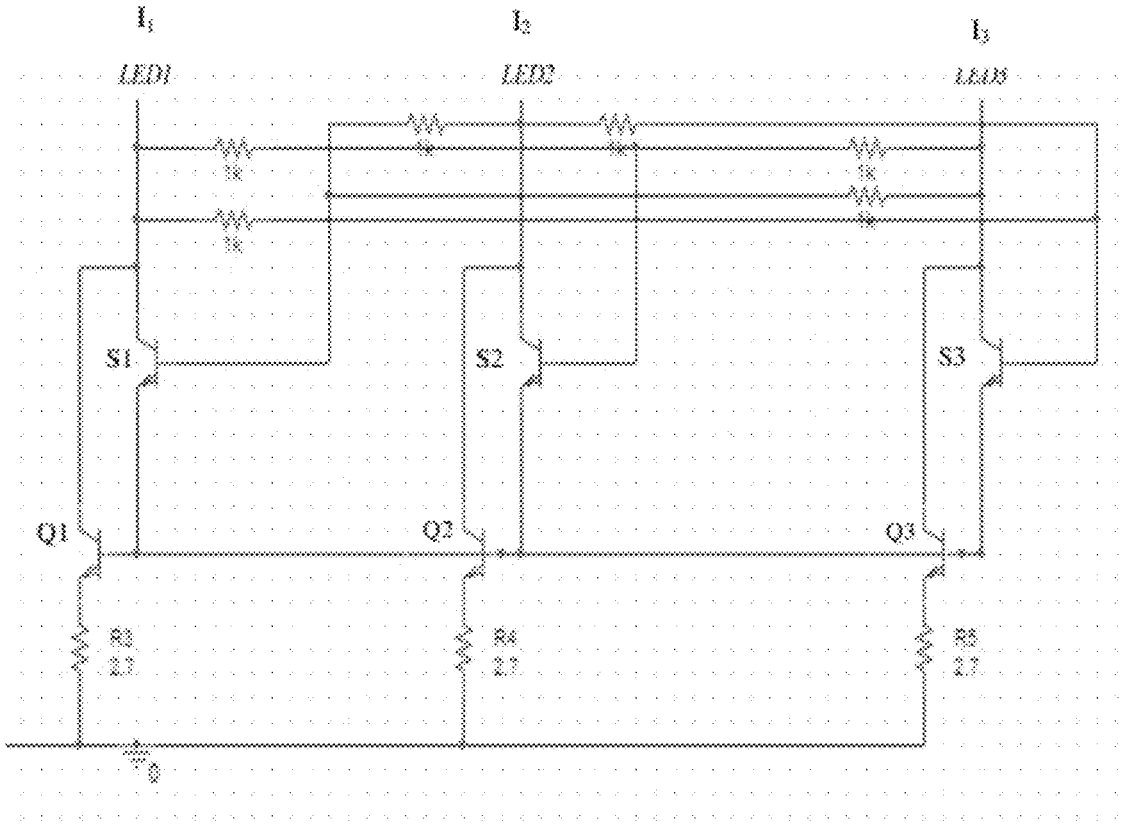
FIG. 23 is a schematic diagram of a current balancing circuit in accordance with a further embodiment of the present invention.

After the alternative circuit of FIG. 23 (based on FIG. 17) is used, the LED string currents become:

| | | | |
|---|---|---|---|
| $I_1$ = 255 mA | $I_2$ = 254 mA | $I_3$ = 265 mA | Maximum ΔI = 11 mA (84% imbalance reduced) |

In both cases, successful current imbalance reduction has been achieved because the current variation has been reduced from 67 mA to 27 mA and 11 mA in the two circuits, respectively. Reduction of over 60% of the current imbalance can be achieved in both cases. It should be noted that the current gains of individual transistors should be matched. The variation of current gains can affect the current balancing performance to some extent. Based on the concept of FIG. 17, an alternative circuit shown in FIG. 23 can be used.

It has been demonstrated above that for the current balancing of parallel LED strings, the best choice is to select the LED string with the smallest current. In the case that it is difficult to predetermine the LED string with the smallest current, the re-configurable current balancing or current mirror circuits and techniques discussed above can be adopted.

Another approach is proposed in another embodiment of the invention to ensure that one LED string has the smallest current. As shown in FIG. 24, this idea is to deliberately create a slight current imbalance by introducing an extra component Y to one current branch (such as the branch with current $I_1$ in FIG. 24). This extra component can be any suitable component, such as some type of current sink like, for example, one LED device or one small resistor, which can ensure that this current branch is the smallest amongst all the parallel branches. Since the branch with the smallest current is deliberately created, this branch can be chosen as the reference branch for any standard or modified current mirror techniques.

A feedback assisted self-reconfigurable current balancing or current mirror technique with high accuracy is also provided by embodiments of the present invention.

Figure 25:
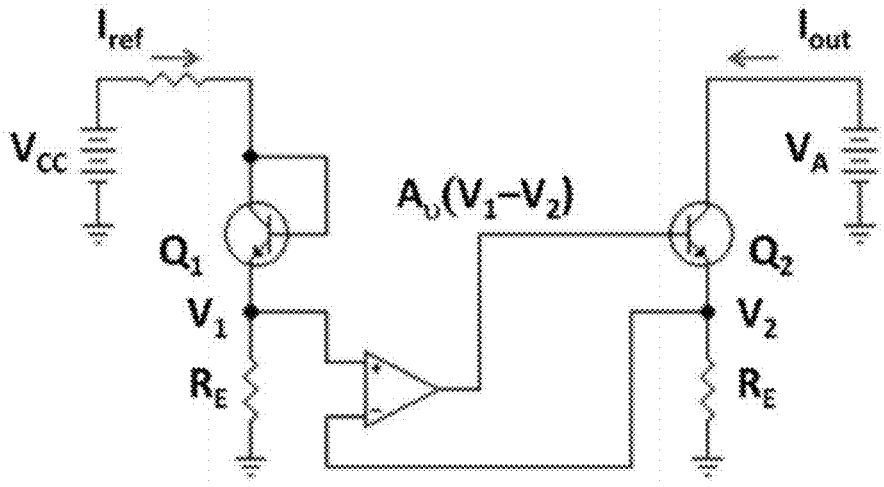
FIG. 25 is a schematic diagram of a feedback assisted current mirror circuit of the prior art.

Based on the self-configurable mechanism described above to automatically select the appropriate current branch as the reference for the current balancing circuit, in another embodiment, the use of an operational amplifier (opamp) for feedback assistance, as shown in FIG. 25, can be incorporated to form a highly accurate current balancing or current mirror technique.

For an ideal opamp or an opamp with very high gain, the potential of the inverting input (v−) of the opamp follows that of the non-inverting input (v+). This means that the potential differences across the two identical resistors $R_E$ in the emitters of the two BJTs are identical. This in turn means that the currents in the resistors $R_E$ of the two strings are the same.

In order to incorporate this feedback assisted concept into the re-configurable current balancing technique, a further circuit example for two LED strings is shown in FIG. 26, in which an opamp is used to provide such feedback, in accordance with an embodiment of the invention. It is to be noted that a low-cost DC power supply is derived from the voltage across one LED module with the help of a RC filter circuit. It should, however, be appreciated that other simple methods to derive this DC power supply, such as using a zener diode as a voltage reference, can also be used.

The two $R_E$ resistors R1 and R2 in FIG. 26 are small resistors typically not higher than 1Ω. BJTs S5 and S7 in FIG. 26 can be replaced by a BJT with high gain or replaced by a Darlington transistor.

Figure 27:
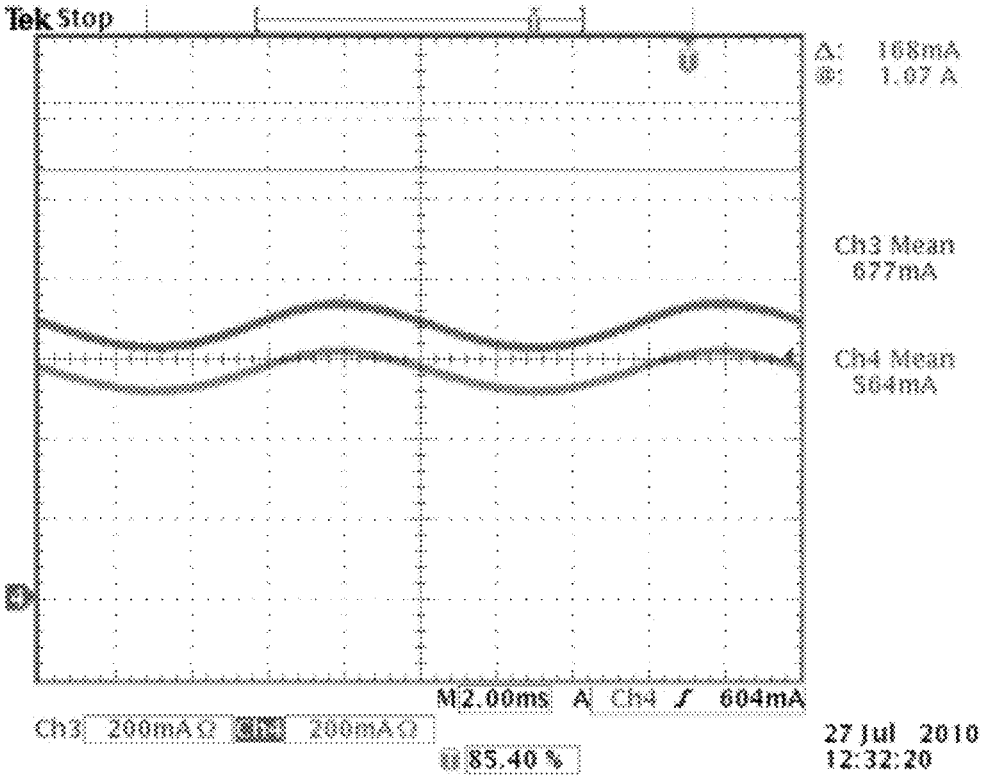
FIG. 27 is a graph showing the measured currents in the two LED strings of the current balancing circuit depicted in FIG. 26, in which the feedback assistance circuit has been removed, and showing the current in one string being 677 mA and the current in the other string being 564 mA.
Figure 28:
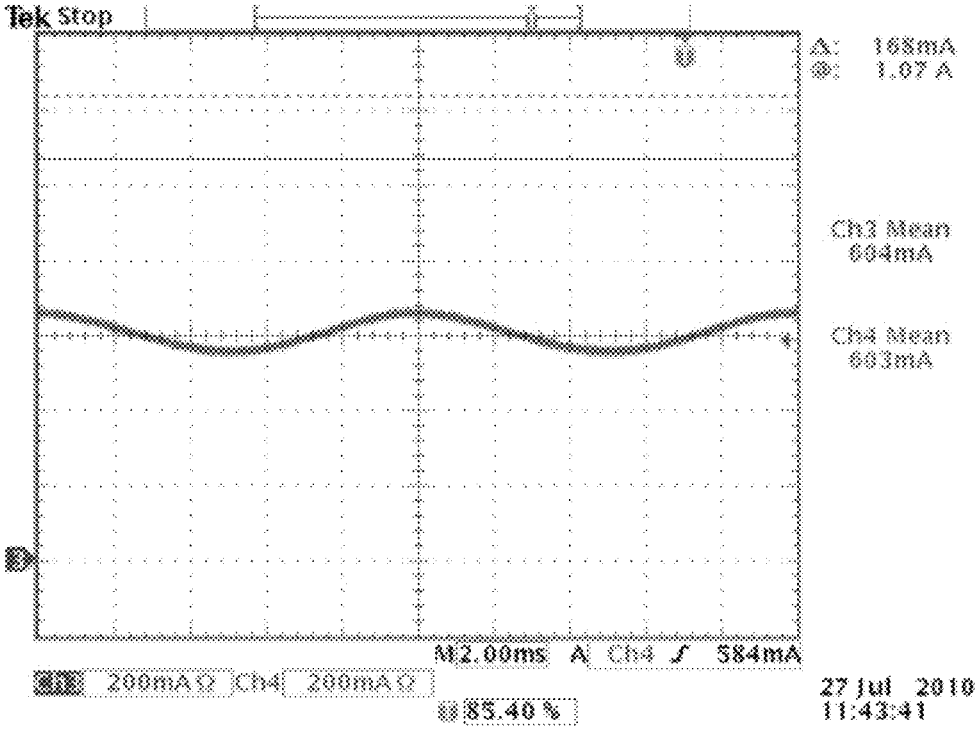
FIG. 28 is a graph showing the measured currents in the two LED strings of the current balancing circuit depicted in FIG. 26, in which the feedback assistance circuit has been included, and showing the current in one string being 604 mA and the current in the other string being 603 mA.

FIG. 27 shows the two measured currents of 677 mA and 564 mA (with a difference of 113 mA) when the feedback assisted circuit depicted in FIG. 26 is removed. FIG. 28 shows the two measured string currents of 604 mA and 603 mA (with a difference of 1 mA) when the feedback assisted circuit depicted in FIG. 26 is included.

The same concept can be extended to more than two strings as shown in an example for three parallel strings in FIG. 29 in accordance with another embodiment. Resistors R2, R3 and R4 are $R_E$ resistors as described above.

The present invention also provides a method for balancing the respective currents in a plurality of parallel circuit branches in a target circuit. A preferred embodiment of the method includes providing the plurality of balancing transistors Q1 to QN as described above, each having a collector, an emitter, and a base, the collector and emitter of each balancing transistor connected in series with a respective circuit branch. The method also includes selectively connecting the circuit branch having the smallest current amongst the circuit branches to the bases of each balancing transistor. The circuit branch having the smallest current amongst the circuit branches is preferably selectively connected to the bases of each balancing transistor using passive circuitry, therefore avoiding the need for a separate or external power supply.

The present embodiment automatically and dynamically connecting the circuit branch having the smallest current amongst the circuit branches to the bases of each balancing transistor Q1 to QN.

In some embodiments, the selection circuits described above are utilized.

The present embodiment also includes further balancing the currents in the circuit branches using feedback assistance by obtaining feedback from the circuit branches and adjusting the currents based on the feedback. For example, the feedback circuit described above can be employed.

In another embodiment, the method includes fixedly setting the current of a predetermined one of the circuit branches at a value lower than the current of the other circuit branches. The method preferably includes providing a current sink in the predetermined branch for reducing the current in the predetermined circuit branch.

Other steps in further embodiments of the method according to the invention will be easily appreciated from the foregoing description.

Although the invention has been described with reference to specific examples, it will be appreciated by those skilled in the art that the invention can be embodied in many other forms. It will also be appreciated by those skilled in the art that the features of the various examples described can be combined in other combinations.

The invention claimed is:

1. A current balancing circuit for balancing the respective currents in a plurality of parallel circuit branches in a target circuit, the current balancing circuit including:

a plurality of balancing transistors, each having a collector, an emitter, and a base, the collector and emitter of each balancing transistor connected in series with a respective circuit branch; and a selection circuit for selectively connecting the circuit branch having the smallest current amongst the circuit branches to the bases of each balancing transistor.

2. A current balancing circuit according to claim 1 wherein the current balancing circuit is passive.

3. A current balancing circuit according to claim 1 wherein the selection circuit automatically and dynamically connects the circuit branch having the smallest current amongst the circuit branches to the bases of each balancing transistor.

4. A current balancing circuit according to claim 1 wherein the selection circuit includes a selection switch for each circuit branch, each selection switch connected between the respective circuit branch and the base of the balancing transistor connected in the respective circuit branch, the selection circuit selectively closing one of the selection switches to selectively connect the circuit branch having the smallest current amongst the circuit branches to the bases of each balancing transistor.

5. A current balancing circuit according to claim 1 wherein the bases of each balancing transistor are interconnected such that when the selection circuit selectively connects the circuit branch having the smallest current amongst the circuit branches to the base of one of the balancing transistors, the circuit branch having the smallest current amongst the circuit branches is also connected to the bases of the other balancing transistors.

6. A current balancing circuit according to claim 4 wherein the selection circuit includes a selection diode for each circuit branch, each selection diode connected from a respective circuit branch and forwardly biased towards a first point, each selection switch connected to a second point, and the first and second points being interconnected.

7. A current balancing circuit according to claim 6 wherein the first and second points are interconnected through a limiting resistor.

8. A current balancing circuit according to claim 6 wherein each selection switch is a switching transistor having a collector, an emitter, and a base, the collector of each switching transistor connected to the respective circuit branch, the emitter of each switching transistor connected to the base of the balancing transistor connected in the respective circuit branch, and the base of each switching transistor connected to the second point.

9. A current balancing circuit according to claim 8 wherein if the current imbalance amongst the circuit branches is insufficient to drive to saturation any of the switching transistors, current from the circuit branch having the largest current amongst the circuit branches flows to each switching transistor with each switching transistor operating in a linear mode.

10. A current balancing circuit according to claim 8 wherein the bases of each balancing transistor are interconnected, and wherein if the current imbalance amongst the circuit branches is sufficient to drive to saturation the selection transistor connected in the circuit branch having the smallest current amongst the circuit branches, current from the circuit branch having the largest current amongst the circuit branches flows to the selection transistor connected in the circuit branch having the smallest current amongst the circuit branches, thereby connecting the circuit branch having the smallest current amongst the circuit branches to the interconnected bases of each balancing transistor.

11. A current balancing circuit according to claim 8 including a blocking diode for each switching transistor, each blocking diode connected between the respective circuit branch and the collector of the respective switching transistor with the blocking diode being forwardly biased towards the collector of the respective switching transistor.

12. A current balancing circuit according to claim 4 wherein the selection circuit includes a network of selection resistors connected between the circuit branches and the selection switches, the network of selection resistors configured to selectively close one of the selection switches to selectively connect the circuit branch having the smallest current amongst the circuit branches to the bases of each balancing transistor.

13. A current balancing circuit according to claim 12 wherein each selection switch is a switching transistor having a collector, an emitter, and a base, the collector of each switching transistor connected to the respective circuit branch, the emitter of each switching transistor connected to the base of the balancing transistor connected in the respective circuit branch, and the base of each switching transistor connected to the network of selection resistors.

14. A current balancing circuit according to claim 13 wherein if the current imbalance amongst the circuit branches is insufficient to drive to saturation any of the switching transistors, current from the circuit branch having the largest current amongst the circuit branches flows to each switching transistor with each switching transistor operating in a linear mode.

15. A current balancing circuit according to claim 13 wherein the bases of each balancing transistor are interconnected, and wherein if the current imbalance amongst the circuit branches is sufficient to drive to saturation the selection transistor connected in the circuit branch having the smallest current amongst the circuit branches, current from the circuit branch having the largest current amongst the circuit branches flows to the selection transistor connected in the circuit branch having the smallest current amongst the circuit branches, thereby connecting the circuit branch having the smallest current amongst the circuit branches to the interconnected bases of each balancing transistor.

16. A current balancing circuit according to claim 13 including a blocking diode for each switching transistor, each blocking diode connected between the respective circuit branch and the collector of the respective switching transistor with the blocking diode being forwardly biased towards the collector of the respective switching transistor.

17. A current balancing circuit according to claim 1 including a stability resistor for each balancing transistor, each stability resistor connected in series between the emitter of the respective balancing transistor and the respective circuit branch.

18. A current balancing circuit according to claim 1 including a feedback assistance circuit connected to the circuit branches to further balance the current in the circuit branches.

19. A current balancing circuit according to claim 18 wherein the feedback assistance circuit includes at least one opamp connected between two of the circuit branches, the opamp having an inverting input connected to one of the two circuit branches, a non-inverting input connected to the other of the two circuit branches, and an output connected to the base of the balancing transistor connected in one of the two circuit branches.

20. A current balancing circuit according to claim 19 wherein the opamp is powered by the voltage across one of the circuit branches.

21. A current balancing circuit according to claim 20 wherein the opamp is powered by a power circuit having an RC filter.

22. A current balancing circuit according to claim 1 wherein the selection circuit fixedly sets the current of a predetermined one of the circuit branches at a value lower than the current of the other circuit branches.

23. A current balancing circuit according to claim 22 wherein the predetermined circuit branch includes a current sink for reducing the current in the predetermined circuit branch.

24. A current balancing circuit according to claim 23 wherein the current sink is a resistive component.

25. A current balancing circuit according to claim 24 wherein the resistive component is a resistor.

26. A current balancing circuit according to claim 22 wherein the selection circuit includes a connection between the predetermined circuit branch and the bases of each balancing transistor.

27. A method for balancing the respective currents in a plurality of parallel circuit branches in a target circuit, the method including:

providing a plurality of balancing transistors, each having a collector, an emitter, and a base, the collector and emitter of each balancing transistor connected in series with a respective circuit branch; and selectively connecting the circuit branch having the smallest current amongst the circuit branches to the bases of each balancing transistor.

28. A method according to claim 27 wherein the circuit branch having the smallest current amongst the circuit branches is selectively connected to the bases of each balancing transistor using passive circuitry.

29. A method according to claim 27 including automatically and dynamically connecting the circuit branch having the smallest current amongst the circuit branches to the bases of each balancing transistor.

30. A method according to claim 27 including further balancing the currents in the circuit branches using feedback assistance by obtaining feedback from the circuit branches and adjusting the currents based on the feedback.

31. A method according to claim 27 including fixedly setting the current of a predetermined one of the circuit branches at a value lower than the current of the other circuit branches.

32. A method according to claim 31 including providing a current sink in the predetermined branch for reducing the current in the predetermined circuit branch.

* * * * *